US009820042B1

(12) United States Patent
Ray et al.

(10) Patent No.: US 9,820,042 B1
(45) Date of Patent: Nov. 14, 2017

(54) STEREO SEPARATION AND DIRECTIONAL SUPPRESSION WITH OMNI-DIRECTIONAL MICROPHONES

(71) Applicant: Knowles Electronics, LLC, Itasca, IL (US)

(72) Inventors: Jonathon Ray, Santa Clara, CA (US); John Woodruff, Palo Alto, CA (US); Shailesh Sakri, Fremont, CA (US); Tony Verma, San Francisco, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/144,631

(22) Filed: May 2, 2016

(51) Int. Cl.
*H04R 3/00* (2006.01)
*H04R 1/32* (2006.01)
*H04S 1/00* (2006.01)

(52) U.S. Cl.
CPC ..... *H04R 3/005* (2013.01); *H04R 1/326* (2013.01); *H04S 1/002* (2013.01); *H04R 2430/20* (2013.01)

(58) Field of Classification Search
CPC ..... H04R 3/005; H04R 1/326; H04S 1/002
See application file for complete search history.

(56) References Cited

U.S. PATENT DOCUMENTS 4,137,510 A 1/1979 Iwahara
4,969,203 A 11/1990 Herman
5,204,906 A 4/1993 Nohara et al.
5,224,170 A 6/1993 Waite, Jr.
5,230,022 A 7/1993 Sakata
5,400,409 A 3/1995 Linhard
(Continued)

FOREIGN PATENT DOCUMENTS

CN 105474311 A 4/2016
DE 112014003337 T5 3/2016
(Continued)

OTHER PUBLICATIONS

Boll, Steven F "Suppression of Acoustic Noise in Speech using Spectral Subtraction", IEEE Transactions on Acoustics, Speech and Signal Processing, vol. ASSP-27, No. 2, Apr. 1979, pp. 113-120.
(Continued)

*Primary Examiner* — Simon King
(74) *Attorney, Agent, or Firm* — Foley & Lardner LLP

(57) ABSTRACT

Systems and methods for stereo separation and directional suppression are provided. An example method includes receiving a first audio signal, representing sound captured by a first microphone associated with a first location, and a second audio signal, representing sound captured by a second microphone associated with a second location. The microphones comprise omni-directional microphones. The distance between the first and second microphones is limited by the size of a mobile device. A first channel signal of a stereo signal is generated by forming, based on the first and second audio signals, a first beam at the first location. A second channel signal of the stereo signal is generated by forming, based on the first and second audio signals, a second beam at the second location. First and second directions, associated respectively with the first and second beams, are fixed relative to a line between the first and second locations.

24 Claims, 12 Drawing Sheets

(56) References Cited

U.S. PATENT DOCUMENTS 5,440,751 A 8/1995 Santeler et al.
5,544,346 A 8/1996 Amini et al.
5,555,306 A 9/1996 Gerzon
5,583,784 A 12/1996 Kapust et al.
5,598,505 A 1/1997 Austin et al.
5,682,463 A 10/1997 Allen et al.
5,796,850 A 8/1998 Shiono et al.
5,806,025 A 9/1998 Vis et al.
5,937,070 A 8/1999 Todter et al.
5,956,674 A 9/1999 Smyth et al.
5,974,379 A 10/1999 Hatanaka et al.
5,974,380 A 10/1999 Smyth et al.
5,978,567 A 11/1999 Rebane et al.
5,978,824 A 11/1999 Ikeda
6,104,993 A 8/2000 Ashley
6,188,769 B1 2/2001 Jot et al.
6,202,047 B1 3/2001 Ephraim et al.
6,226,616 B1 5/2001 You et al.
6,236,731 B1 5/2001 Brennan et al.
6,240,386 B1 5/2001 Thyssen et al.
6,263,307 B1 7/2001 Arslan et al.
6,377,637 B1 4/2002 Berdugo
6,421,388 B1 7/2002 Parizhsky et al.
6,477,489 B1 11/2002 Lockwood et al.
6,490,556 B1 12/2002 Graumann et al.
6,496,795 B1 12/2002 Malvar
6,584,438 B1 6/2003 Manjunath et al.
6,772,117 B1 8/2004 Laurila et al.
6,810,273 B1 10/2004 Mattila et al.
6,862,567 B1 3/2005 Gao
6,907,045 B1 6/2005 Robinson et al.
7,054,809 B1 5/2006 Gao
7,058,574 B2 6/2006 Taniguchi et al.
7,254,242 B2 8/2007 Ise et al.
7,283,956 B2 10/2007 Ashley et al.
7,366,658 B2 4/2008 Moogi et al.
7,383,179 B2 6/2008 Alves et al.
7,433,907 B2 10/2008 Nagai et al.
7,472,059 B2 12/2008 Huang
7,548,791 B1 6/2009 Johnston
7,555,434 B2 6/2009 Nomura et al.
7,590,250 B2 9/2009 Ellis et al.
7,617,099 B2 11/2009 Yang et al.
7,657,427 B2 2/2010 Jelinek
7,899,565 B1 3/2011 Johnston
8,032,369 B2 10/2011 Manjunath et al.
8,036,767 B2 10/2011 Soulodre
8,046,219 B2 10/2011 Zurek et al.
8,060,363 B2 11/2011 Ramo et al.
8,098,844 B2 1/2012 Elko
8,150,065 B2 4/2012 Solbach et al.
8,194,880 B2 6/2012 Avendano
8,194,882 B2 6/2012 Every et al.
8,195,454 B2 6/2012 Muesch
8,204,253 B1 6/2012 Solbach
8,233,352 B2 7/2012 Beaucoup
8,311,817 B2 11/2012 Murgia et al.
8,345,890 B2 1/2013 Avendano et al.
8,473,287 B2 6/2013 Every et al.
8,615,394 B1 12/2013 Avendano et al.
8,694,522 B1 4/2014 Pance
8,744,844 B2 6/2014 Klein
8,774,423 B1 7/2014 Solbach
8,831,937 B2 9/2014 Murgia et al.
8,880,396 B1 11/2014 Laroche et al.
8,908,882 B2 12/2014 Goodwin et al.
8,934,641 B2 1/2015 Avendano et al.
8,989,401 B2 3/2015 Ojanpera
9,094,496 B2 7/2015 Teutsch
9,185,487 B2 11/2015 Solbach et al.
9,197,974 B1 11/2015 Clark et al.
9,210,503 B2 12/2015 Avendano et al.
9,247,192 B2 1/2016 Lee et al.
9,330,669 B2 5/2016 Stonehocker et al.
2001/0041976 A1 11/2001 Taniguchi et al.
2002/0097884 A1 7/2002 Cairns
2003/0023430 A1 1/2003 Wang et al.
2003/0228019 A1 12/2003 Eichler et al.
2004/0066940 A1 4/2004 Amir
2004/0083110 A1 4/2004 Wang
2004/0133421 A1 7/2004 Burnett et al.
2004/0165736 A1 8/2004 Hetherington et al.
2005/0008169 A1 1/2005 Muren et al.
2005/0008179 A1 1/2005 Quinn
2005/0043959 A1 2/2005 Stemerdink et al.
2005/0080616 A1 4/2005 Leung et al.
2005/0096904 A1 5/2005 Taniguchi et al.
2005/0143989 A1 6/2005 Jelinek
2005/0249292 A1 11/2005 Zhu
2005/0261896 A1 11/2005 Schuijers et al.
2005/0276363 A1 12/2005 Joublin et al.
2005/0281410 A1 12/2005 Grosvenor et al.
2005/0283544 A1 12/2005 Yee
2006/0100868 A1 5/2006 Hetherington et al.
2006/0136203 A1 6/2006 Ichikawa
2006/0198542 A1 9/2006 Benjelloun Touimi et al.
2006/0242071 A1 10/2006 Stebbings
2006/0270468 A1 11/2006 Hui et al.
2006/0293882 A1 12/2006 Giesbrecht et al.
2007/0025562 A1 2/2007 Zalewski et al.
2007/0033494 A1 2/2007 Wenger et al.
2007/0038440 A1 2/2007 Sung et al.
2007/0058822 A1 3/2007 Ozawa
2007/0067166 A1 3/2007 Pan et al.
2007/0088544 A1 4/2007 Acero et al.
2007/0100612 A1 5/2007 Ekstrand et al.
2007/0136056 A1 6/2007 Moogi et al.
2007/0136059 A1 6/2007 Gadbois
2007/0150268 A1 6/2007 Acero et al.
2007/0154031 A1 7/2007 Avendano et al.
2007/0198254 A1 8/2007 Goto et al.
2007/0237271 A1 10/2007 Pessoa et al.
2007/0244695 A1 10/2007 Manjunath et al.
2007/0253574 A1 11/2007 Soulodre
2007/0276656 A1 11/2007 Solbach et al.
2007/0282604 A1 12/2007 Gartner et al.
2007/0287490 A1 12/2007 Green et al.
2008/0019548 A1 1/2008 Avendano
2008/0069366 A1 3/2008 Soulodre
2008/0101626 A1 5/2008 Samadani
2008/0111734 A1 5/2008 Fam et al.
2008/0117901 A1 5/2008 Klammer
2008/0118082 A1 5/2008 Seltzer et al.
2008/0140396 A1 6/2008 Grosse-Schulte et al.
2008/0192956 A1 8/2008 Kazama
2008/0195384 A1 8/2008 Jabri et al.
2008/0208575 A1 8/2008 Laaksonen et al.
2008/0212795 A1 9/2008 Goodwin et al.
2008/0247567 A1 10/2008 Kjolerbakken et al.
2008/0310646 A1 12/2008 Amada
2008/0317261 A1 12/2008 Yoshida et al.
2009/0012783 A1 1/2009 Klein
2009/0012784 A1 1/2009 Murgia et al.
2009/0018828 A1 1/2009 Nakadai et al.
2009/0048824 A1 2/2009 Amada
2009/0060222 A1 3/2009 Jeong et al.
2009/0070118 A1 3/2009 Den Brinker et al.
2009/0086986 A1 4/2009 Schmidt et al.
2009/0106021 A1 4/2009 Zurek et al.
2009/0112579 A1 4/2009 Li et al.
2009/0119096 A1 5/2009 Gerl et al.
2009/0119099 A1 5/2009 Lee et al.
2009/0144053 A1 6/2009 Tamura et al.
2009/0144058 A1 6/2009 Sorin
2009/0192790 A1 7/2009 El-Maleh et al.
2009/0204413 A1 8/2009 Sintes et al.
2009/0216526 A1 8/2009 Schmidt et al.
2009/0226005 A1 9/2009 Acero et al.
2009/0226010 A1 9/2009 Schnell et al.
2009/0228272 A1 9/2009 Herbig et al.
2009/0257609 A1 10/2009 Gerkmann et al.
2009/0262969 A1 10/2009 Short et al.
2009/0287481 A1 11/2009 Paranjpe et al.
2009/0292536 A1 11/2009 Hetherington et al.

(56) References Cited

U.S. PATENT DOCUMENTS

| | | | | |
|---|---|---|---|---|
| 2009/0303350 | A1 | 12/2009 | Terada | |
| 2009/0323982 | A1 | 12/2009 | Solbach et al. | |
| 2010/0004929 | A1 | 1/2010 | Baik | |
| 2010/0033427 | A1 | 2/2010 | Marks et al. | |
| 2010/0094643 | A1 | 4/2010 | Avendano et al. | |
| 2010/0211385 | A1 | 8/2010 | Sehlstedt | |
| 2010/0228545 | A1 | 9/2010 | Ito et al. | |
| 2010/0245624 | A1 | 9/2010 | Beaucoup | |
| 2010/0280824 | A1 | 11/2010 | Petit et al. | |
| 2010/0296668 | A1 | 11/2010 | Lee et al. | |
| 2011/0038486 | A1 | 2/2011 | Beaucoup | |
| 2011/0038557 | A1 | 2/2011 | Closset et al. | |
| 2011/0044324 | A1 | 2/2011 | Li et al. | |
| 2011/0058676 | A1* | 3/2011 | Visser | 381/17 |
| 2011/0075857 | A1 | 3/2011 | Aoyagi | |
| 2011/0081024 | A1 | 4/2011 | Soulodre | |
| 2011/0107367 | A1 | 5/2011 | Georgis et al. | |
| 2011/0129095 | A1 | 6/2011 | Avendano et al. | |
| 2011/0137646 | A1 | 6/2011 | Ahgren et al. | |
| 2011/0142257 | A1 | 6/2011 | Goodwin et al. | |
| 2011/0182436 | A1 | 7/2011 | Murgia et al. | |
| 2011/0184732 | A1 | 7/2011 | Godavarti | |
| 2011/0184734 | A1 | 7/2011 | Wang et al. | |
| 2011/0191101 | A1 | 8/2011 | Uhle et al. | |
| 2011/0208520 | A1 | 8/2011 | Lee | |
| 2011/0257965 | A1 | 10/2011 | Hardwick | |
| 2011/0257967 | A1 | 10/2011 | Every et al. | |
| 2011/0264449 | A1 | 10/2011 | Sehlstedt | |
| 2012/0013768 | A1 | 1/2012 | Zurek et al. | |
| 2012/0019689 | A1 | 1/2012 | Zurek et al. | |
| 2012/0076316 | A1* | 3/2012 | Zhu | H04R 3/005 381/71.11 |
| 2012/0116758 | A1 | 5/2012 | Murgia et al. | |
| 2012/0123775 | A1 | 5/2012 | Murgia et al. | |
| 2012/0209611 | A1 | 8/2012 | Furuta et al. | |
| 2012/0257778 | A1 | 10/2012 | Hall et al. | |
| 2013/0272511 | A1 | 10/2013 | Bouzid et al. | |
| 2013/0289988 | A1 | 10/2013 | Fry | |
| 2013/0289996 | A1 | 10/2013 | Fry | |
| 2013/0322461 | A1 | 12/2013 | Poulsen | |
| 2013/0332156 | A1 | 12/2013 | Tackin et al. | |
| 2013/0343549 | A1* | 12/2013 | Vemireddy | H04R 5/027 381/17 |
| 2014/0003622 | A1 | 1/2014 | Ikizyan et al. | |
| 2014/0126726 | A1 | 5/2014 | Heiman et al. | |
| 2014/0241529 | A1* | 8/2014 | Lee | H04R 5/027 381/26 |
| 2014/0350926 | A1 | 11/2014 | Schuster et al. | |
| 2014/0379338 | A1 | 12/2014 | Fry | |
| 2015/0025881 | A1 | 1/2015 | Carlos et al. | |
| 2015/0078555 | A1 | 3/2015 | Zhang et al. | |
| 2015/0078606 | A1 | 3/2015 | Zhang et al. | |
| 2015/0088499 | A1 | 3/2015 | White et al. | |
| 2015/0112672 | A1 | 4/2015 | Giacobello et al. | |
| 2015/0139428 | A1* | 5/2015 | Reining | H04R 3/007 381/55 |
| 2015/0206528 | A1 | 7/2015 | Wilson et al. | |
| 2015/0208165 | A1 | 7/2015 | Volk et al. | |
| 2015/0237470 | A1 | 8/2015 | Mayor et al. | |
| 2015/0277847 | A1* | 10/2015 | Yliaho | G06F 3/16 381/122 |
| 2015/0364137 | A1 | 12/2015 | Katuri et al. | |
| 2016/0037245 | A1 | 2/2016 | Harrington | |
| 2016/0061934 | A1 | 3/2016 | Woodruff et al. | |
| 2016/0078880 | A1 | 3/2016 | Avendano et al. | |
| 2016/0093307 | A1 | 3/2016 | Warren et al. | |
| 2016/0094910 | A1 | 3/2016 | Vallabhan et al. | |
| 2016/0133269 | A1 | 5/2016 | Dusan et al. | |
| 2016/0162469 | A1 | 6/2016 | Santos | |

FOREIGN PATENT DOCUMENTS

| | | | |
|---|---|---|---|
| EP | 1081685 | A2 | 3/2001 |
| FI | 20080623 | A | 11/2008 |
| FI | 20110428 | A | 12/2011 |
| FI | 20125600 | A | 6/2012 |
| FI | 123080 | B | 10/2012 |
| JP | H05172865 | A | 7/1993 |
| JP | H05300419 | A | 11/1993 |
| JP | H07336793 | A | 12/1995 |
| JP | 2004053895 | A | 2/2004 |
| JP | 2004531767 | A | 10/2004 |
| JP | 2004533155 | A | 10/2004 |
| JP | 2005148274 | A | 6/2005 |
| JP | 2005518118 | A | 6/2005 |
| JP | 2005309096 | A | 11/2005 |
| JP | 2006515490 | A | 5/2006 |
| JP | 2007201818 | A | 8/2007 |
| JP | 2008518257 | A | 5/2008 |
| JP | 2008542798 | A | 11/2008 |
| JP | 2009037042 | A | 2/2009 |
| JP | 2009538450 | A | 11/2009 |
| JP | 2012514233 | A | 6/2012 |
| JP | 5081903 | B2 | 11/2012 |
| JP | 2013513306 | A | 4/2013 |
| JP | 2013527479 | A | 6/2013 |
| JP | 5718251 | B2 | 5/2015 |
| JP | 5855571 | B2 | 2/2016 |
| KR | 1020060024498 | | 3/2006 |
| KR | 1020070068270 | | 6/2007 |
| KR | 101050379 | B1 | 12/2008 |
| KR | 1020080109048 | | 12/2008 |
| KR | 1020090013221 | | 2/2009 |
| KR | 1020110111409 | | 10/2011 |
| KR | 1020120094892 | | 8/2012 |
| KR | 1020120101457 | | 9/2012 |
| KR | 101294634 | B1 | 8/2013 |
| KR | 101610662 | B1 | 4/2016 |
| TW | 519615 | B | 2/2003 |
| TW | 200847133 | A | 12/2008 |
| TW | 201113873 | A | 4/2011 |
| TW | 201143475 | A | 12/2011 |
| TW | I421858 | B | 1/2014 |
| TW | 201513099 | A | 4/2015 |
| WO | WO0207061 | | 1/2002 |
| WO | WO02080362 | | 10/2002 |
| WO | WO02103676 | | 12/2002 |
| WO | WO03069499 | | 8/2003 |
| WO | WO2004010415 | A1 | 1/2004 |
| WO | WO2005086138 | A1 | 9/2005 |
| WO | WO2007140003 | A2 | 12/2007 |
| WO | WO2008034221 | A1 | 3/2008 |
| WO | WO2010077361 | A1 | 7/2010 |
| WO | WO2011002489 | A1 | 1/2011 |
| WO | WO2011068901 | A1 | 6/2011 |
| WO | WO2012094422 | A2 | 7/2012 |
| WO | WO2015010129 | A1 | 1/2015 |
| WO | WO2016040885 | A1 | 3/2016 |
| WO | WO2016049566 | A1 | 3/2016 |
| WO | WO2016094418 | A1 | 6/2016 |
| WO | WO2016109103 | A1 | 7/2016 |

OTHER PUBLICATIONS

"ENT 172." Instructional Module. Prince George's Community College Department of Engineering Technology. Accessed: Oct. 15, 2011. Subsection: "Polar and Rectangular Notation". <http://academic.ppgcc.edu/ent/ent172_instr_mod.html>.

Fulghum, D. P. et al., "LPC Voice Digitizer with Background Noise Suppression", 1979 IEEE International Conference on Acoustics, Speech, and Signal Processing, pp. 220-223.

Haykin, Simon et al., "Appendix A.2 Complex Numbers." Signals and Systems. 2nd Ed. 2003. p. 764.

Hohmann, V. "Frequency Analysis and Synthesis Using a Gammatone Filterbank", ACTA Acustica United with Acustica, 2002, vol. 88, pp. 433-442.

Martin, Rainer "Spectral Subtraction Based on Minimum Statistics", in Proceedings Europe. Signal Processing Conf., 1994, pp. 1182-1185.

Mitra, Sanjit K. Digital Signal Processing: a Computer-based Approach. 2nd Ed. 2001. pp. 131-133.

(56) References Cited

OTHER PUBLICATIONS

Cosi, Piero et al., (1996), "Lyon's Auditory Model Inversion: a Tool for Sound Separation and Speech Enhancement," Proceedings of ESCA Workshop on 'The Auditory Basis of Speech Perception,' Keele University, Keele (UK), Jul. 15-19, 1996, pp. 194-197.
Rabiner, Lawrence R. et al., "Digital Processing of Speech Signals", (Prentice-Hall Series in Signal Processing). Upper Saddle River, NJ: Prentice Hall, 1978.
Schimmel, Steven et al., "Coherent Envelope Detection for Modulation Filtering of Speech," 2005 IEEE International Conference on Acoustics, Speech, and Signal Processing, vol. 1, No. 7, pp. 221-224.
Slaney, Malcom, et al., "Auditory Model Inversion for Sound Separation," 1994 IEEE International Conference on Acoustics, Speech and Signal Processing, Apr. 19-22, vol. 2, pp. 77-80.
Slaney, Malcom. "An Introduction to Auditory Model Inversion", Interval Technical Report IRC 1994-014, http://coweb.ecn.purdue.edu/~maclom/interval/1994-014/, Sep. 1994, accessed on Jul. 6, 2010.
Solbach, Ludger "An Architecture for Robust Partial Tracking and Onset Localization in Single Channel Audio Signal Mixes", Technical University Hamburg-Harburg, 1998.
International Search Report and Written Opinion dated Sep. 16, 2008 in Patent Cooperation Treaty Application No. PCT/US2007/012628.
International Search Report and Written Opinion dated May 20, 2010 in Patent Cooperation Treaty Application No. PCT/US2009/006754.
Fast Cochlea Transform, US Trademark Reg. No. 2,875,755 (Aug. 17, 2004).
3GPP2 "Enhanced Variable Rate Codec, Speech Service Options 3, 68, 70, and 73 for Wideband Spread Spectrum Digital Systems", May 2009, pp. 1-308.
3GPP2 "Selectable Mode Vocoder (SMV) Service Option for Wideband Spread Spectrum Communication Systems", Jan. 2004, pp. 1-231.
3GPP2 "Source-Controlled Variable-Rate Multimode Wideband Speech Codec (VMR-WB) Service Option 62 for Spread Spectrum Systems", Jun. 11, 2004, pp. 1-164.
3GPP "3GPP Specification 26.071 Mandatory Speech CODEC Speech Processing Functions; AMR Speech Codec; General Description", http://www.3gpp.org/ftp/Specs/html-info/26071.htm, accessed on Jan. 25, 2012.
3GPP "3GPP Specification 26.094 Mandatory Speech Codec Speech Processing Functions; Adaptive Multi-Rate (AMR) Speech Codec; Voice Activity Detector (VAD)", http://www.3gpp.org/ftp/Specs/html-info/26094.htm, accessed on Jan. 25, 2012.
3GPP "3GPP Specification 26.171 Speech Codec Speech Processing Functions; Adaptive Multi-Rate—Wideband (AMR-WB) Speech Codec; General Description", http://www.3gpp.org/ftp/Specs/html-info26171.htm, accessed on Jan. 25, 2012.
3GPP "3GPP Specification 26.194 Speech Codec Speech Processing Functions; Adaptive Multi-Rate—Wideband (AMR-WB) Speech Codec; Voice Activity Detector (VAD)" http://www.3gpp.org/ftp/Specs/html-info26194.htm, accessed on Jan. 25, 2012.
International Telecommunication Union "Coding of Speech at 8 kbit/s Using Conjugate-Structure Algebraic-code-excited Linear-prediction (CS-ACELP)", Mar. 19, 1996, pp. 1-39.
International Telecommunication Union "Coding of Speech at 8 kbit/s Using Conjugate Structure Algebraic-code-excited Linear-prediction (CS-ACELP) Annex B: A Silence Compression Scheme for G.729 Optimized for Terminals Conforming to Recommendation V.70", Nov. 8, 1996, pp. 1-23.
International Search Report and Written Opinion dated Aug. 19, 2010 in Patent Cooperation Treaty Application No. PCT/US2010/001786.
International Search Report and Written Opinion dated Feb. 7, 2011 in Patent Cooperation Treaty Application No. PCT/US2010/058600, filed Dec. 1, 2010.
Cisco, "Understanding How Digital T1 CAS (Robbed Bit Signaling) Works in IOS Gateways", Jan. 17, 2007, http://www.cisco.com/image/gif/paws/22444/t1-cas-ios.pdf, accessed on Apr. 3, 2012.
Jelinek et al., "Noise Reduction Method for Wideband Speech Coding" Proc. Eusipco, Vienna, Austria, Sep. 2004, pp. 1959-1962.
Widjaja et al., "Application of Differential Microphone Array for IS-127 EVRC Rate Determination Algorithm", Interspeech 2009, 10th Annual Conference of the International Speech Communication Association, Brighton, United Kingdom Sep. 6-10, 2009, pp. 1123-1126.
Sugiyama et al., "Single-Microphone Noise Suppression for 3G Handsets Based on Weighted Noise Estimation" in Benesty et al., "Speech Enhancement", 2005, pp. 115-133, Springer Berlin Heidelberg.
Watts, "Real-Time, High-Resolution Simulation of the Auditory Pathway, with Application to Cell-Phone Noise Reduction" Proceedings of 2010 IEEE International Symposium on Circuits and Systems (ISCAS), May 30-Jun. 2, 2010, pp. 3821-3824.
3GPP Minimum Performance Specification for the Enhanced Variable rate Codec, Speech Service Option 3 and 68 or Wideband Spread Spectrum Digital Systems, Jul. 2007, pp. 1-83.
Ramakrishnan, 2000. Reconstruction of Incomplete Spectrograms for robust speech recognition. PhD thesis, Carnegie Mellon University, Pittsburgh, Pennsylvania.
Kim et al., "Missing-Feature Reconstruction by Leveraging Temporal Spectral Correlation for Robust Speech Recognition in Background Noise Conditions, "Audio, Speech, and Language Processing, IEEE Transactions on, vol. 18, No. 8 pp. 2111-2120, Nov. 2010.
Cooke et al.,"Robust Automatic Speech Recognition with Missing and Unreliable Acoustic data," Speech Commun., vol. 34, No. 3, pp. 267-285, 2001.
Liu et al., "Efficient cepstral normalization for robust speech recognition." Proceedings of the workshop on Human Language Technology. Association for Computational Linguistics, 1993.
Yoshizawa et al., "Cepstral gain normalization for noise robust speech recognition." Acoustics, Speech, and Signal Processing, 2004. Proceedings, (ICASSP04), IEEE International Conference on vol. 1 IEEE, 2004.
Office Action dated Apr. 8, 2014 in Japan Patent Application 2011-544416, filed Dec. 30, 2009.
Elhilali et al.,"A cocktail party with a cortical twist: How cortical mechanisms contribute to sound segregation." J. Acoust. Soc. Am., vol. 124, No. 6, Dec. 2008; 124(6): 3751-3771).
Jin et al., "HMM-Based Multipitch Tracking for Noisy and Reverberant Speech." Jul. 2011.
Kawahara, W., et al., "Tandem-Straight: A temporally stable power spectral representation for periodic signals and applications to interference-free spectrum, F0, and aperiodicity estimation." IEEE ICASSP 2008.
Lu et al. "A Robust Audio Classification and Segmentation Method." Microsoft Research, 2001, pp. 203, 206, and 207.
Office Action dated Aug. 26, 2014 in Japan Application No. 2012-542167, filed Dec. 1, 2010.
International Search Report & Written Opinion dated Nov. 12, 2014 in Patent Cooperation Treaty Application No. PCT/US2014/047458, filed Jul. 21, 2014.
Office Action dated Oct. 31, 2014 in Finland Patent Application No. 20125600, filed Jun. 1, 2012.
Krini, Mohamed et al., "Model-Based Speech Enhancement," in Speech and Audio Processing in Adverse Environments; Signals and Communication Technology, edited by Hansler et al., 2008, Chapter 4, pp. 89-134.
Office Action dated Dec. 9, 2014 in Japan Patent Application No. 2012-518521, filed Jun. 21, 2010.
Office Action dated Dec. 10, 2014 in Taiwan Patent Application No. 099121290, filed Jun. 29, 2010.
Purnhagen, Heiko, "Low Complexity Parametric Stereo Coding in MPEG-4," Proc. of the 7th Int. Conference on Digital Audio Effects (DAFx'04), Naples, Italy, Oct. 5-8, 2004.
Chang, Chun-Ming et al., "Voltage-Mode Multifunction Filter with Single Input and Three Outputs Using Two Compound Current Conveyors" IEEE Transactions on Circuits and Systems-I: Fundamental Theory and Applications, vol. 46, No. 11, Nov. 1999.

(56) References Cited

OTHER PUBLICATIONS

Nayebi et al., "Low delay FIR filter banks: design and evaluation" IEEE Transactions on Signal Processing, vol. 42, No. 1, pp. 24-31, Jan. 1994.
Notice of Allowance dated Feb. 17, 2015 in Japan Patent Application No. 2011-544416, filed Dec. 30, 2009.
Office Action dated Jan. 30, 2015 in Finland Patent Application No. 20080623, filed May 24, 2007.
Office Action dated Mar. 27, 2015 in Korean Patent Application No. 10-2011-7016591, filed Dec. 30, 2009.
Office Action dated Jul. 21, 2015 in Japan Patent Application No. 2012-542167, filed Dec. 1, 2010.
Notice of Allowance dated Aug. 13, 2015 in Finnish Patent Application 20080623, filed May 24, 2007.
Office Action dated Sep. 29, 2015 in Finland Patent Application No. 20125600, filed Dec. 1, 2010.
Office Action dated Oct. 15, 2015 in Korean Patent Application 10-2011-7016591.
Allowance dated Nov. 17, 2015 in Japan Patent Application No. 2012-542167, filed Dec. 1, 2010.
International Search Report & Written Opinion dated Dec. 14, 2015 in Patent Cooperation Treaty Application No. PCT/US2015/049816, filed Sep. 11, 2015.
International Search Report & Written Opinion dated Dec. 22, 2015 in Patent Cooperation Treaty Application No. PCT/US2015/052433, filed Sep. 25, 2015.
Notice of Allowance dated Jan. 14, 2016 in South Korean Patent Application No. 10-2011-7016591 filed Jul. 15, 2011.
International Search Report & Written Opinion dated Feb. 12, 2016 in Patent Cooperation Treaty Application No. PCT/US2015/064523, filed Dec. 8, 2015.
International Search Report & Written Opinion dated Feb. 11, 2016 in Patent Cooperation Treaty Application No. PCT/US2015/063519, filed Dec. 2, 2015.
Klein, David, "Noise-Robust Multi-Lingual Keyword Spotting with a Deep Neural Network Based Architecture", U.S. Appl. No. 14/614,348, filed Feb. 4, 2015.
Vitus, Deborah Kathleen et al., "Method for Modeling User Possession of Mobile Device for User Authentication Framework", U.S. Appl. No. 14/548,207, filed Nov. 19, 2014.
Murgia, Carlo, "Selection of System Parameters Based on Non-Acoustic Sensor Information", U.S. Appl. No. 14/331,205, filed Jul. 14, 2014.
Goodwin, Michael M. et al., "Key Click Suppression", U.S. Appl. No. 14/745,176, filed Jun. 19, 2015.
Office Action dated May 17, 2016 in Korean Patent Application 1020127001822 filed Jun. 21, 2010.
Lauber, Pierre et al., "Error Concealment for Compressed Digital Audio," Audio Engineering Society, 2001.
Non-Final Office Action, dated Aug. 5, 2008, U.S. Appl. No. 11/441,675, filed May 25, 2006.
Non-Final Office Action, dated Jan. 21, 2009, U.S. Appl. No. 11/441,675, filed May 25, 2006.
Final Office Action, dated Sep. 3, 2009, U.S. Appl. No. 11/441,675, filed May 25, 2006.
Non-Final Office Action, dated May 10, 2011, U.S. Appl. No. 11/441,675, filed May 25, 2006.
Final Office Action, dated Oct. 24, 2011, U.S. Appl. No. 11/441,675, filed May 25, 2006.
Non-Final Office Action, dated Dec. 6, 2011, U.S. Appl. No. 12/319,107, filed Dec. 31, 2008.
Notice of Allowance, dated Feb. 13, 2012, U.S. Appl. No. 11/441,675, filed May 25, 2006.
Non-Final Office Action, dated Feb. 14, 2012, U.S. Appl. No. 13/295,981, filed Nov. 14, 2011.
Non-Final Office Action, dated Feb. 21, 2012, U.S. Appl. No. 13/288,858, filed Nov. 3, 2011.
Final Office Action, dated Apr. 16, 2012, U.S. Appl. No. 12/319,107, filed Dec. 31, 2008.
Advisory Action, dated Jun. 28, 2012, U.S. Appl. No. 12/319,107, filed Dec. 31, 2008.
Final Office Action, dated Jul. 9, 2012, U.S. Appl. No. 13/295,981, filed Nov. 14, 2011.
Final Office Action, dated Jul. 17, 2012, U.S. Appl. No. 13/295,981, filed Nov. 14, 2011.
Non-Final Office Action, dated Aug. 28, 2012, U.S. Appl. No. 12/860,515, filed Aug. 20, 2010.
Notice of Allowance, dated Sep. 10, 2012, U.S. Appl. No. 13/288,858, filed Nov. 3, 2011.
Advisory Action, dated Sep. 24, 2012, U.S. Appl. No. 13/295,981, filed Nov. 14, 2011.
Non-Final Office Action, dated Oct. 2, 2012, U.S. Appl. No. 12/906,009, filed Oct. 15, 2010.
Non-Final Office Action, dated Oct. 11, 2012, U.S. Appl. No. 12/896,725, filed Oct. 1, 2010.
Non-Final Office Action, dated Dec. 10, 2012, U.S. Appl. No. 12/493,927, filed Jun. 29, 2009.
Final Office Action, dated Mar. 11, 2013, U.S. Appl. No. 12/860,515, filed Aug. 20, 2010.
Non-Final Office Action, dated Apr. 24, 2013, U.S. Appl. No. 13/012,517, filed Jan. 24, 2011.
Non-Final Office Action, dated May 10, 2013, U.S. Appl. No. 13/751,907, filed Jan. 28, 2013.
Final Office Action, dated May 14, 2013, U.S. Appl. No. 12/493,927, filed Jun. 29, 2009.
Final Office Action, dated May 22, 2013, U.S. Appl. No. 12/896,725, filed Oct. 1, 2010.
Non-Final Office Action, dated Jul. 2, 2013, U.S. Appl. No. 12/906,009, filed Oct. 15, 2010.
Non-Final Office Action, dated Jul. 31, 2013, U.S. Appl. No. 13/009,732, filed Jan. 19, 2011.
Non-Final Office Action, dated Aug. 28, 2013, U.S. Appl. No. 12/860,515, filed Aug. 20, 2010.
Notice of Allowance, dated Sep. 17, 2013, U.S. Appl. No. 13/751,907, filed Jan. 28, 2013.
Final Office Action, dated Dec. 3, 2013, U.S. Appl. No. 13/012,517, filed Jan. 24, 2011.
Non-Final Office Action, dated Jan. 3, 2014, U.S. Appl. No. 12/319,107, filed Dec. 31, 2008.
Non-Final Office Action, dated Jan. 9, 2014, U.S. Appl. No. 12/493,927, filed Jun. 29, 2009.
Non-Final Office Action, dated Jan. 30, 2014, U.S. Appl. No. 12/896,725, filed Oct. 1, 2010.
Final Office Action, dated May 7, 2014, U.S. Appl. No. 12/906,009, filed Oct. 15, 2010.
Notice of Allowance, dated May 9, 2014, U.S. Appl. No. 13/295,981, filed Nov. 14, 2011.
Notice of Allowance, dated Jun. 18, 2014, U.S. Appl. No. 12/860,515, filed Aug. 20, 2010.
Notice of Allowance, dated Aug. 20, 2014, U.S. Appl. No. 12/493,927, filed Jun. 29, 2009.
Notice of Allowance, dated Aug. 25, 2014, U.S. Appl. No. 12/319,107, filed Dec. 31, 2008.
Non-Final Office Action, dated Nov. 19, 2014, U.S. Appl. No. 12/896,725, filed Oct. 1, 2010.
Non-Final Office Action, dated Nov. 19, 2014, U.S. Appl. No. 13/012,517, filed Jan. 24, 2011.
Final Office Action, dated Dec. 16, 2014, U.S. Appl. No. 13/009,732, filed Jan. 19, 2011.
Non-Final Office Action, dated Apr. 21, 2015, U.S. Appl. No. 12/906,009, filed Oct. 15, 2010.
Final Office Action, dated Jun. 17, 2015, U.S. Appl. No. 13/012,517, filed Jan. 24, 2011.
Notice of Allowance, dated Jul. 30, 2015, U.S. Appl. No. 12/896,725, filed Oct. 1, 2010.
Non-Final Office Action, dated Dec. 28, 2015, U.S. Appl. No. 14/081,723, filed Nov. 15, 2013.
Non-Final Office Action, dated Feb. 1, 2016, U.S. Appl. No. 14/335,850, filed Jul. 18, 2014.
Non-Final Office Action, dated Jun. 22, 2016, U.S. Appl. No. 13/012,517, filed Jan. 24, 2011.

(56) References Cited

OTHER PUBLICATIONS

Non-Final Office Action, dated Jun. 24, 2016, U.S. Appl. No. 14/962,931, filed Dec. 8, 2015.
International Search Report and Written Opinion, PCT/US2017/030220, Knowles Electronics LLC (14 pages) dated Aug. 30, 2017.

* cited by examiner

STEREO SEPARATION AND DIRECTIONAL SUPPRESSION WITH OMNI-DIRECTIONAL MICROPHONES

FIELD

The present invention relates generally to audio processing, and, more specifically, to systems and methods for stereo separation and directional suppression with omni-directional microphones.

BACKGROUND

Recording stereo audio with a mobile device, such as smartphones and tablet computers, may be useful for making video of concerts, performances, and other events. Typical stereo recording devices are designed with either large separation between microphones or with precisely angled directional microphones to utilize acoustic properties of the directional microphones to capture stereo effects. Mobile devices, however, are limited in size and, therefore, the distance between microphones is significantly smaller than a minimum distance required for optimal omni-directional microphone stereo separation. Using directional microphones is not practical due to the size limitations of the mobile devices and may result in an increase in overall costs associated with the mobile devices. Additionally, due to the limited space for placing directional microphones, a user of the mobile device can be a dominant source for the directional microphones, often interfering with target sound sources.

Another aspect of recording stereo audio using a mobile device is a problem of capturing acoustically representative signals to be used in subsequent processing. Traditional microphones used for mobile devices may not able to handle high pressure conditions in which stereo recording is performed, such as a performance, concert, or a windy environment. As a result, signals generated by the microphones can become distorted due to reaching their acoustic overload point (AOP).

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Provided are systems and methods for stereo separation and directional suppression with omni-directional microphones. An example method includes receiving at least a first audio signal and a second audio signal. The first audio signal can represent sound captured by a first microphone associated with a first location. The second audio signal can represent sound captured by a second microphone associated with a second location. The first microphone and the second microphone can include omni-directional microphones. The method can include generating a first channel signal of a stereo audio signal by forming, based on the at least first audio signal and second audio signal, a first beam at the first location. The method can also include generating a second channel signal of the stereo audio signal by forming, based on the at least first audio signal and second audio signal, a second beam at the second location.

In some embodiments, a distance between the first microphone and the second microphone is limited by a size of a mobile device. In certain embodiments, the first microphone is located at the top of the mobile device and the second microphone is located at the bottom of the mobile device. In other embodiments, the first and second microphones (and additional microphones, if any) may be located differently, including but not limited to, the microphones being located along a side of the device, e.g., separated along the side of a tablet having microphones on the side.

In some embodiments, directions of the first beam and the second beam are fixed relative to a line between the first location and the second location. In some embodiments, the method further includes receiving at least one other acoustic signal. The other acoustic signal can be captured by another microphone associated with another location. The other microphone includes an omni-directional microphone. In some embodiments, forming the first beam and the second beam is further based on the other acoustic signal. In some embodiments, the other microphone is located off the line between the first microphone and the second microphone.

In some embodiments, forming the first beam includes reducing signal energy of acoustic signal components associated with sources outside the first beam. Forming the second beam can include reducing signal energy of acoustic signal components associated with further sources off the second beam. In certain embodiments, reducing signal energy is performed by a subtractive suppression. In some embodiments, the first microphone and the second microphone include microphones having an acoustic overload point (AOP) greater than a pre-determined sound pressure level. In certain embodiments, the pre-determined sound pressure level is 120 decibels.

According to another example embodiment of the present disclosure, the steps of the method for stereo separation and directional suppression with omni-directional microphones are stored on a machine-readable medium comprising instructions, which when implemented by one or more processors perform the recited steps.

Other example embodiments of the disclosure and aspects will become apparent from the following description taken in conjunction with the following drawings.

BRIEF DESCRIPTION OF THE DRAWINGS

Embodiments are illustrated by way of example and not limitation in the figures of the accompanying drawings, in which like references indicate similar elements.

DETAILED DESCRIPTION

The technology disclosed herein relates to systems and methods for stereo separation and directional suppression with omni-directional microphones. Embodiments of the present technology may be practiced with audio devices operable at least to capture and process acoustic signals. In some embodiments, the audio devices may be hand-held devices, such as wired and/or wireless remote controls, notebook computers, tablet computers, phablets, smart phones, personal digital assistants, media players, mobile telephones, and the like. The audio devices can have radio frequency (RF) receivers, transmitters and transceivers; wired and/or wireless telecommunications and/or networking devices; amplifiers; audio and/or video players; encoders; decoders; speakers; inputs; outputs; storage devices; and user input devices. Audio devices may have input devices such as buttons, switches, keys, keyboards, trackballs, sliders, touch screens, one or more microphones, gyroscopes, accelerometers, global positioning system (GPS) receivers, and the like. The audio devices may have outputs, such as LED indicators, video displays, touchscreens, speakers, and the like.

In various embodiments, the audio devices operate in stationary and portable environments. The stationary environments can include residential and commercial buildings or structures and the like. For example, the stationary embodiments can include concert halls, living rooms, bedrooms, home theaters, conference rooms, auditoriums, business premises, and the like. Portable environments can include moving vehicles, moving persons or other transportation means, and the like.

According to an example embodiment, a method for stereo separation and directional suppression includes receiving at least a first audio signal and a second audio signal. The first audio signal can represent sound captured by a first microphone associated with a first location. The second audio signal can represent sound captured by a second microphone associated with a second location. The first microphone and the second microphone can comprise omni-directional microphones. The example method includes generating a first stereo signal by forming, based on the at least first audio signal and second audio signal, a first beam at the first location. The method can further include generating a second stereo signal by forming, based on the at least first audio signal and second audio signal, a second beam at the second location.

Figure 1:
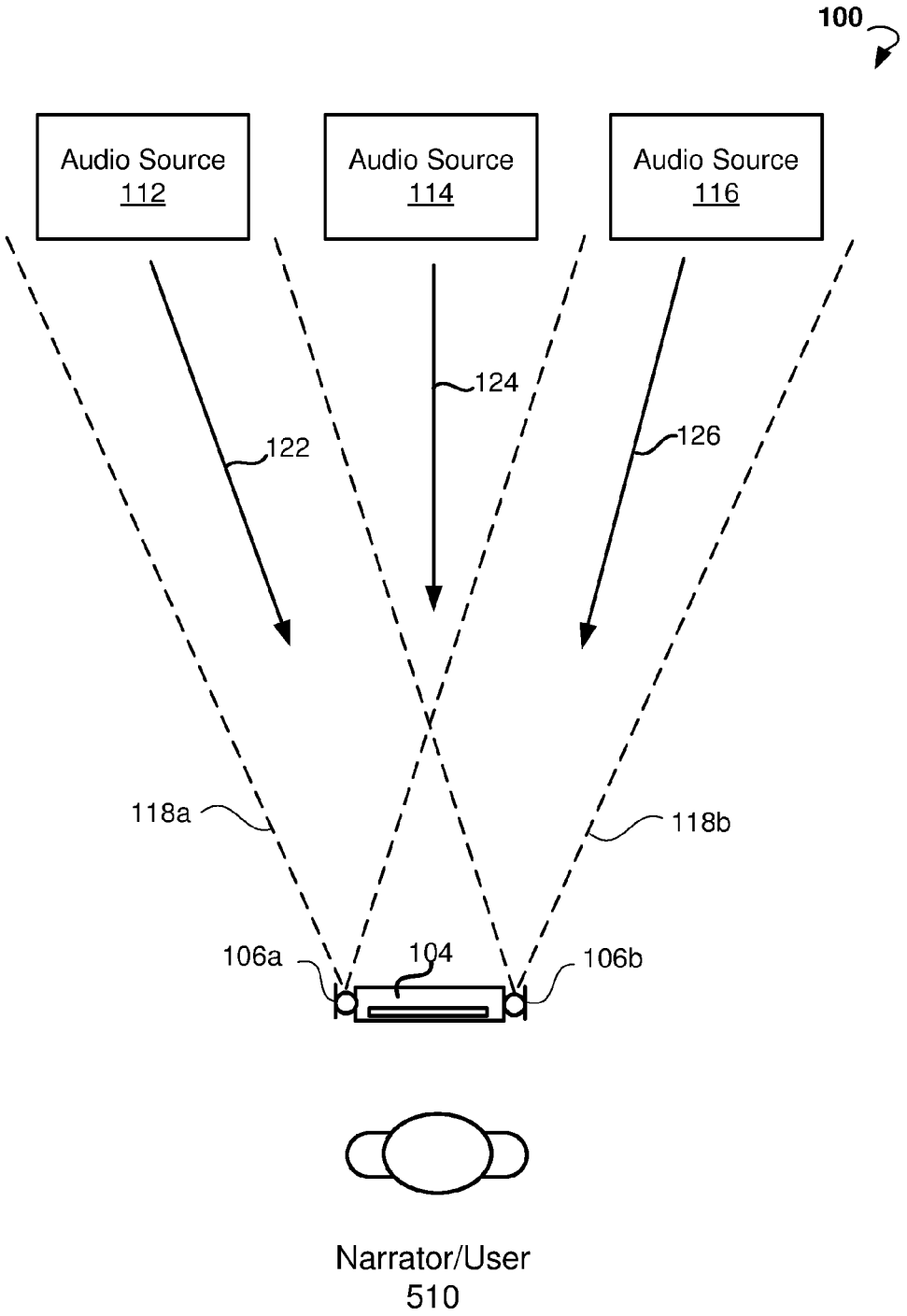
FIG. 1 is a block diagram of an example environment in which the present technology can be used.

FIG. 1 is a block diagram of an example environment 100 in which the embodiments of the present technology can be practiced. The environment 100 of FIG. 1 can include audio device 104 and audio sources 112, 114, and 116. The audio device can include at least a primary microphone 106*a* and a secondary microphone 106*b*.

The primary microphone 106*a* and the secondary microphone 106*b* of the audio device 104 may comprise omni-directional microphones. In some embodiments, the primary microphone 106*a* is located at the bottom of the audio device 104 and, accordingly, may be referred to as the bottom microphone. Similarly, in some embodiments, the secondary microphone 106*b* is located at the top of the audio device 104 and, accordingly, may be referred to as the top microphone. In other embodiments, the first and second microphones (and additional microphones, if any) may be located differently, including but not limited to, the microphones being located along a side of the device, e.g., separated along the side of a tablet having microphones on the side.

Some embodiments if the present disclosure utilize level differences (e.g., energy differences), phase differences, and differences in arrival times between the acoustic signals received by the two microphones 106*a* and 106*b*. Because the primary microphone 106*a* is closer to the audio source 112 than the secondary microphone 106*b*, the intensity level, for the audio signal from audio source 112 (represented graphically by 122, which may also include noise in addition to desired sounds) is higher for the primary microphone 106*a*, resulting in a larger energy level received by the primary microphone 106*a*. Similarly, because the secondary microphone 106*b* is closer to the audio source 116 than the primary microphone 106*a*, the intensity level, for the audio signal from audio source 116 (represented graphically by 126, which may also include noise in addition to desired sounds) is higher for the secondary microphone 106, resulting in a larger energy level received by the secondary microphone 106*b*. On the other hand, the intensity level for the audio signal from audio source 114 (represented graphically by 124, which may also include noise in addition to desired sounds) could be higher for one of the two microphones 106*a* and 106*b*, depending on, for example, its location within cones 108*a* and 108*b*.

The level differences can be used to discriminate between speech and noise in the time-frequency domain. Some embodiments may use a combination of energy level differences and differences in arrival times to discriminate between acoustic signals coming from different directions. In some embodiments, a combination of energy level differences and phase differences is used for directional audio capture.

Various example embodiments of the present technology utilize level differences (e.g. energy differences), phase differences, and differences in arrival times for stereo separation and directional suppression of acoustic signals captured by microphones 106*a* and 106*b*. As shown in FIG. 1, a multi-directional acoustic signal provided by audio sources 112, 114, and 116 can be separated into a left channel signal of a stereo audio signal and a right channel signal of the stereo audio signal (also referred to herein as left and right stereo signals, or left and right channels of the stereo signal). The left channel of the stereo signal can be obtained by focusing on acoustic signals within cone 118*a* and suppressing acoustic signals outside the cone 118*a*. The cone 118*a* can cover audio sources 112 and 114. Similarly, a right channel of the stereo signal can be obtained by focusing on acoustic signals within cone 118*b* and suppressing acoustic signals outside cone 118*b*. The cone 118*b* can cover audio sources 114 and 116. In some embodiments of the present disclosure, audio signals coming from a site associated with user 510 (also referred to as narrator/user 510) are suppressed in both the left channel of the stereo signal and the right channel of the stereo signal. Various embodiments of the present technology can be used for capturing stereo audio when shooting video at home, during concerts, school plays, and so forth.

Figure 2:
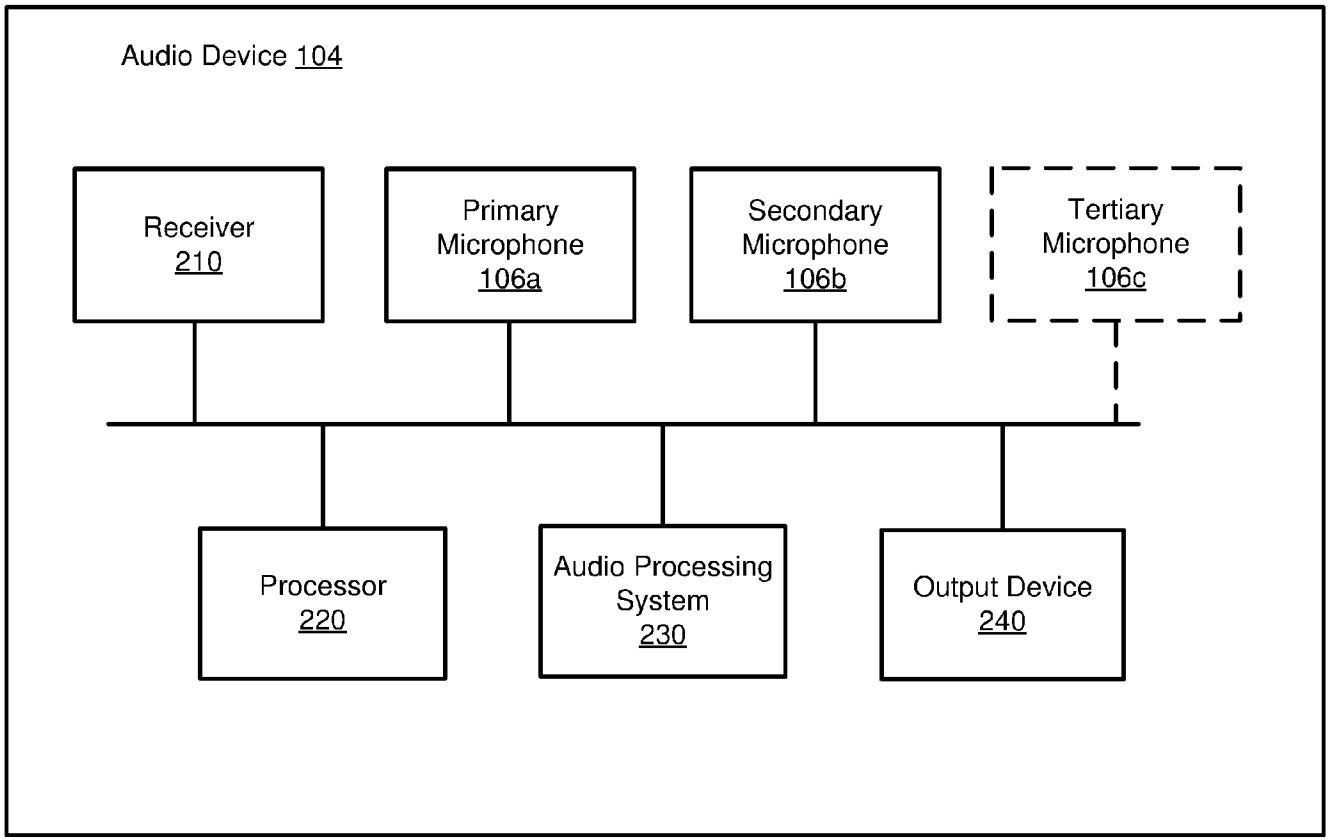
FIG. 2 is a block diagram of an example audio device.

FIG. 2 is a block diagram of an example audio device. In some embodiments, the example audio device of FIG. 2 provides additional details for audio device 104 of FIG. 1. In the illustrated embodiment, the audio device 104 includes a receiver 210, a processor 220, the primary microphone 106*a*, a secondary microphone 106*b*, an audio processing system 230, and an output device 240. In some embodiments, the audio device 104 includes another, optional tertiary microphone 106*c*. The audio device 104 may include additional or different components to enable audio device 104 operations. Similarly, the audio device 104 may include fewer components that perform similar or equivalent functions to those depicted in FIG. 2.

Processor 220 may execute instructions and modules stored in a memory (not illustrated in FIG. 2) of the audio device 104 to perform functionality described herein, including noise reduction for an acoustic signal. Processor 220 may include hardware and software implemented as a processing unit, which may process floating point and/or fixed point operations and other operations for the processor 220.

The example receiver 210 can be a sensor configured to receive a signal from a communications network. In some embodiments, the receiver 210 may include an antenna device. The signal may then be forwarded to the audio processing system 230 for noise reduction and other processing using the techniques described herein. The audio processing system 230 may provide a processed signal to the output device 240 for providing an audio output(s) to the user. The present technology may be used in one or both of the transmitting and receiving paths of the audio device 104.

The audio processing system 230 can be configured to receive acoustic signals that represent sound from acoustic source(s) via the primary microphone 106*a* and secondary microphone 106*b* and process the acoustic signals. The processing may include performing noise reduction for an acoustic signal. The example audio processing system 230 is discussed in more detail below. The primary and secondary microphones 106*a*, 106*b* may be spaced a distance apart in order to allow for detecting an energy level difference, time arrival difference, or phase difference between them. The acoustic signals received by primary microphone 106*a* and secondary microphone 106*b* may be converted into electrical signals (e.g., a primary electrical signal and a secondary electrical signal). The electrical signals may, in turn, be converted by an analog-to-digital converter (not shown) into digital signals, that represent the captured sound, for processing in accordance with some embodiments.

The output device 240 can include any device which provides an audio output to the user. For example, the output device 240 may include a loudspeaker, an earpiece of a headset or handset, or a memory where the output is stored for video/audio extraction at a later time, e.g., for transfer to computer, video disc or other media for use.

In various embodiments, where the primary and secondary microphones include omni-directional microphones that are closely-spaced (e.g., 1-2 cm apart), a beamforming technique may be used to simulate forward-facing and backward-facing directional microphones. The energy level difference may be used to discriminate between speech and noise in the time-frequency domain used in noise reduction.

Figure 3:
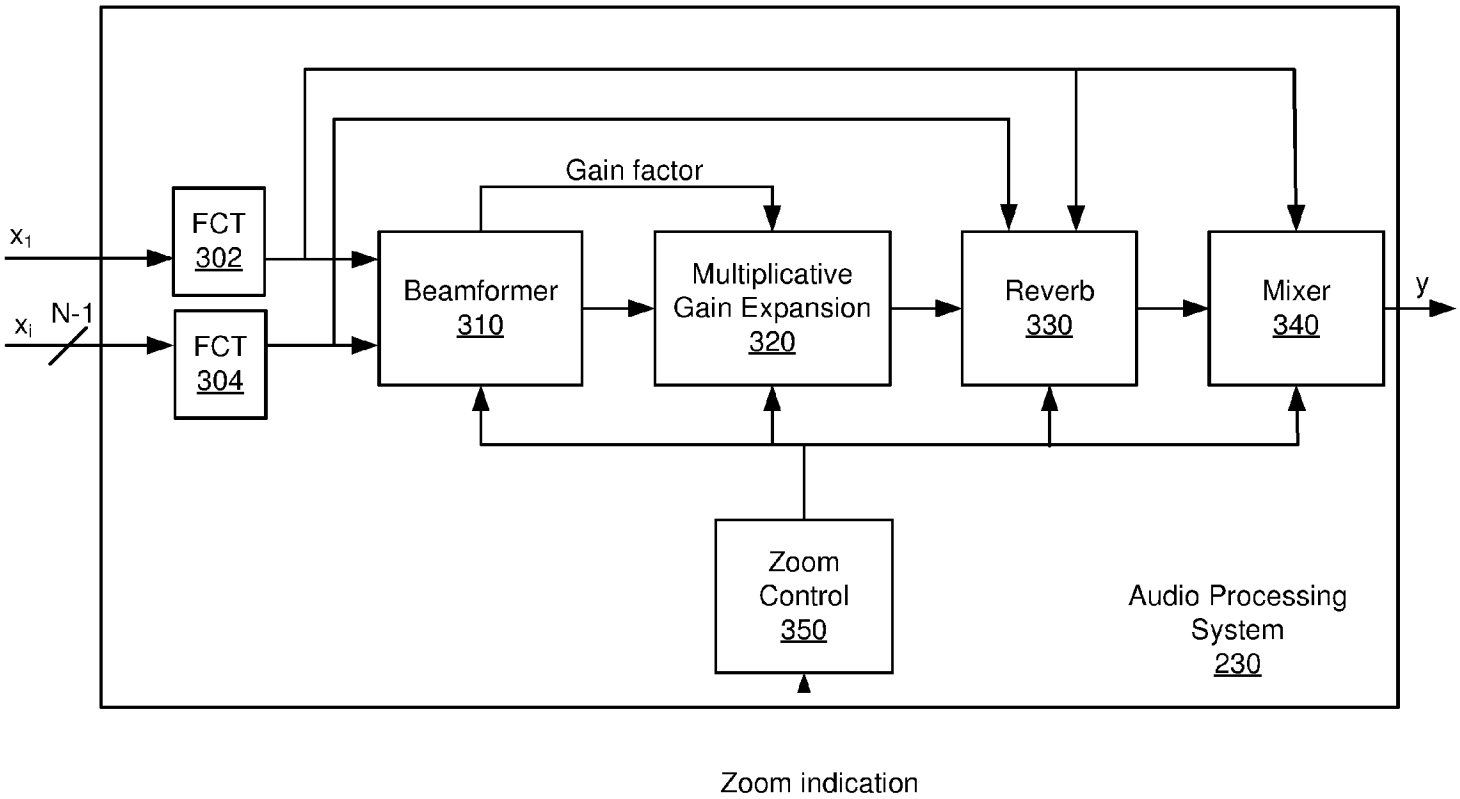
FIG. 3 is a block diagram of an example audio processing system.

FIG. 3 is a block diagram of an example audio processing system. The block diagram of FIG. 3 provides additional details for the audio processing system 230 of the example block diagram of FIG. 2. Audio processing system 230 in this example includes various modules including fast cochlea transform (FCT) 302 and 304, beamformer 310, multiplicative gain expansion 320, reverb 330, mixer 340, and zoom control 350.

FCT 302 and 304 may receive acoustic signals from audio device microphones and convert the acoustic signals into frequency range sub-band signals. In some embodiments, FCT 302 and 304 are implemented as one or more modules operable to generate one or more sub-band signals for each received microphone signal. FCT 302 and 304 can receive an acoustic signal representing sound from each microphone included in audio device 104. These acoustic signals are illustrated as signals $X_1$-$X_I$, wherein $X_1$ represent a primary microphone signal and $X_i$ represents the rest (e.g., N−1) of the microphone signals. In some embodiments, the audio processing system 230 of FIG. 3 performs audio zoom on a per frame and per sub-band basis.

In some embodiments, beamformer 310 receives frequency sub-band signals as well as a zoom indication signal. The zoom indication signal can be received from zoom control 350. The zoom indication signal can be generated in response to user input, analysis of a primary microphone signal, or other acoustic signals received by audio device 104, a video zoom feature selection, or some other data. In operation, beamformer 310 receives sub-band signals, processes the sub-band signals to identify which signals are within a particular area to enhance (or "zoom"), and provide data for the selected signals as output to multiplicative gain expansion module 320. The output may include sub-band signals for the audio source within the area to enhance. Beamformer 310 can also provide a gain factor to multiplicative gain expansion 320. The gain factor may indicate whether multiplicative gain expansion 320 should perform additional gain or reduction to the signals received from beamformer 310. In some embodiments, the gain factor is generated as an energy ratio based on the received microphone signals and components. The gain indication output by beamformer 310 may be a ratio of energy in the energy component of the primary microphone reduced by beamformer 310 to output energy of beamformer 310. Accordingly, the gain may include a boost or cancellation gain expansion factor. An example gain factor is discussed in more detail below.

Beamformer 310 can be implemented as a null processing noise subtraction (NPNS) module, multiplicative module, or a combination of these modules. When an NPNS module is used in microphones to generate a beam and achieve beamforming, the beam is focused by narrowing constraints of alpha ($\alpha$) and gamma ($\sigma$). Accordingly, a beam may be manipulated by providing a protective range for the preferred direction. Exemplary beamformer 310 modules are further described in U.S. patent application Ser. No. 14/957,447, entitled "Directional Audio Capture," and U.S. patent application Ser. No. 12/896,725, entitled "Audio Zoom" (issued as U.S. Pat. No. 9,210,503 on Dec. 8, 2015), the disclosures of which is incorporated herein by reference in its entirety. Additional techniques for reducing undesired audio components of a signal are discussed in U.S. patent application Ser. No. 12/693,998, entitled "Adaptive Noise Reduction Using Level Cues" (issued as U.S. Pat. No. 8,718,290 on May 6, 2014), the disclosure of which is incorporated herein by reference in its entirety.

Multiplicative gain expansion module 320 can receive sub-band signals associated with audio sources within the selected beam, the gain factor from beamformer 310, and the zoom indicator signal. Multiplicative gain expansion module 320 can apply a multiplicative gain based on the gain factor received. In effect, multiplicative gain expansion module 320 can filter the beamformer signal provided by beamformer 310.

The gain factor may be implemented as one of several different energy ratios. For example, the energy ratio may include a ratio of a noise reduced signal to a primary acoustic signal received from a primary microphone, the ratio of a noise reduced signal and a detected noise component within the primary microphone signal, the ratio of a noise reduced signal and a secondary acoustic signal, or the ratio of a noise reduced signal compared to an intra level difference between a primary signal and a further signal. The gain factors may be an indication of signal strength in a target direction versus all other directions. In other words, the gain factor may be indicative of multiplicative expansions and whether these additional expansions should be performed by the multiplicative gain expansion 320. Multiplicative gain expansion 320 can output the modified signal and provide signal to reverb 330 (also referred to herein as reverb (de-reverb) 330).

Reverb 330 can receive the sub-band signals output by multiplicative gain expansion 320, as well as the microphone signals also received by beamformer 310, and perform reverberation (or dereverberation) of the sub-band signal output by multiplicative gain expansion 320. Reverb 330 may adjust a ratio of direct energy to remaining energy within a signal based on the zoom control indicator provided by zoom control 350. After adjusting the reverberation of the received signal, reverb 330 can provide the modified signal to a mixing component, e.g., mixer 340.

The mixer 340 can receive the reverberation adjusted signal and mix the signal with the signal from the primary microphone. In some embodiments, mixer 340 increases the energy of the signal appropriately when audio is present in the frame and decreases the energy when there is little audio energy present in the frame.

Figure 4:
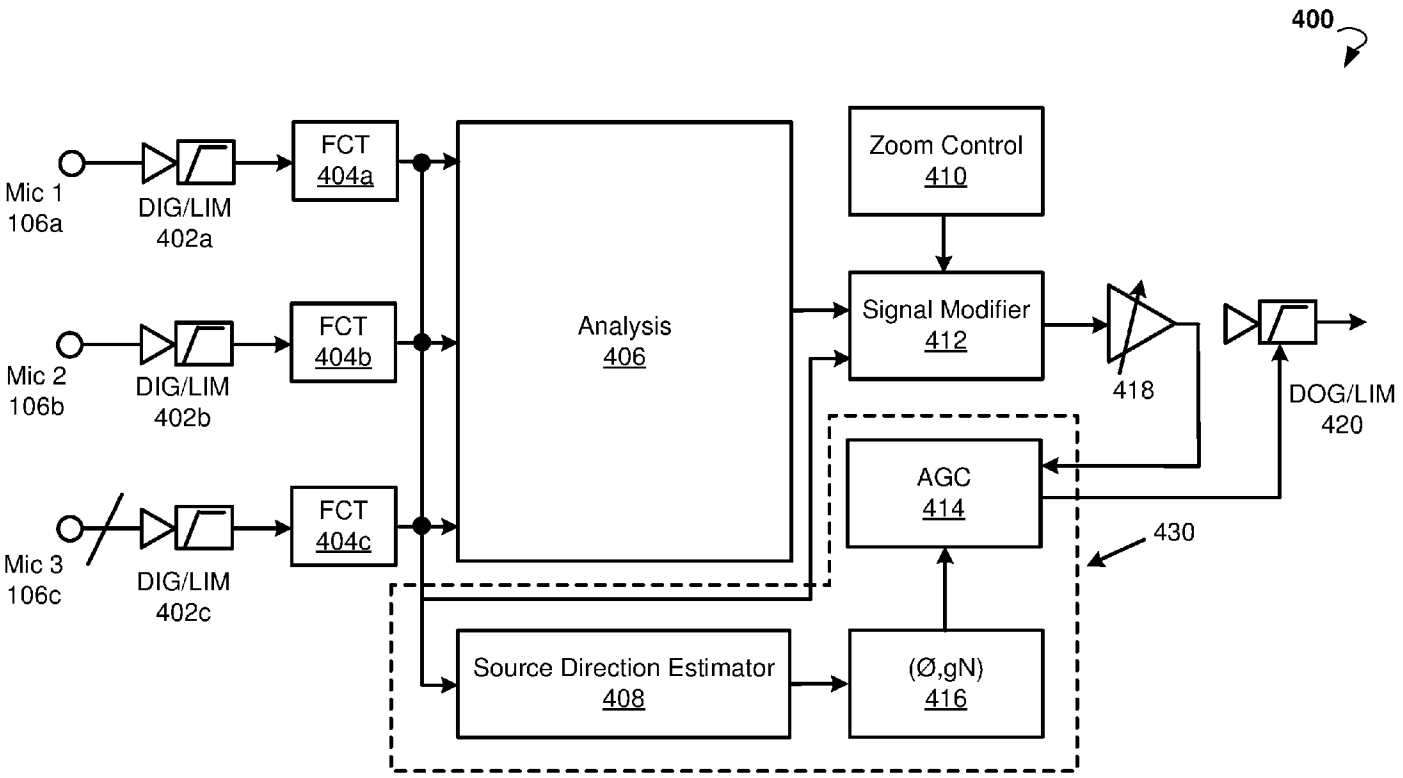
FIG. 4 is a block diagram of an example audio processing system suitable for directional audio capture.

FIG. 4 is a block diagram illustrating an audio processing system 400, according to another example embodiment. The audio processing system 400 can include audio zoom audio (AZA), a subsystem augmented with a source estimation subsystem 430. The example AZA subsystem includes limiters 402*a*, 402*b*, and 402*c*, along with various other modules including FCT 404*a*, 404*b*, and 404*c*, analysis 406, zoom control 410, signal modifier 412, plus variable amplifier 418 and a limiter 420. The source estimation subsystem 430 can include a source direction estimator (SDE) 408 (also referred to variously as SDE module 408 or as a target estimator), a gain (module) 416, and an automatic gain control (AGC) (module) 414. In various embodiments, the audio processing system 400 processes acoustic audio signal from microphones 106*a*, 106*b*, and optionally a third microphone, 106*c*.

In various embodiments, SDE module 408 is operable to localize a source of sound. The SDE module 408 is operable to generate cues based on correlation of phase plots between different microphone inputs. Based on the correlation of the phase plots, the SDE module 408 is operable to compute a vector of salience estimates at different angles. Based on the salience estimates, the SDE module 408 can determine a direction of the source. In other words, a peak in the vector of salience estimates is an indication of direction of a source in a particular direction. At the same time, sources of diffused nature, i.e., non-directional, are represented by poor salience estimates at all the angles. The SDE module 408 can rely upon the cues (estimates of salience) to improve the performance of a directional audio solution, which is carried out by the analysis module 406, signal modifier 412, and zoom control 410. In some embodiments, the signal modifier 412 includes modules analogous or similar to beamformer 310, multiplicative gain expansion module 320, reverb module 330, and mixer module 340 as shown for audio system 230 in FIG. 3.

In some embodiments, estimates of salience are used to localize the angle of the source in the range of 0 to 360 degrees in a plane parallel to the ground, when, for example, the audio device 104 is placed on a table top. The estimates of salience can be used to attenuate/amplify the signals at different angles as required by the customer. The characterization of these modes may be driven by a SDE salience parameter. Example AZA and SDE subsystems are described further in U.S. patent application Ser. No. 14/957,447, entitled "Directional Audio Capture," the disclosure of which is incorporated herein by reference in its entirety.

Figure 5B:
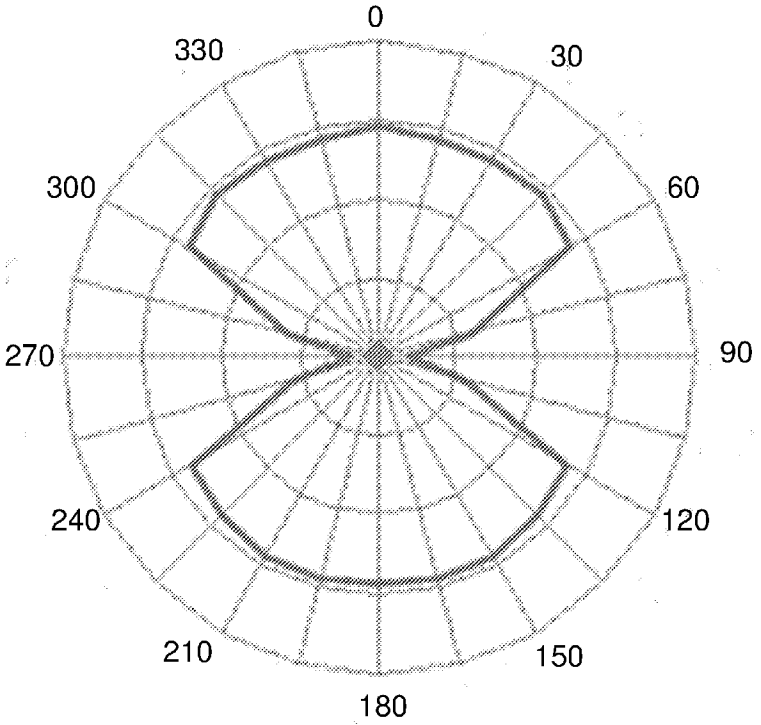
FIG. 5B is a plot showing directional audio signals being captured with two omni-directional microphones.
Figure 5A:
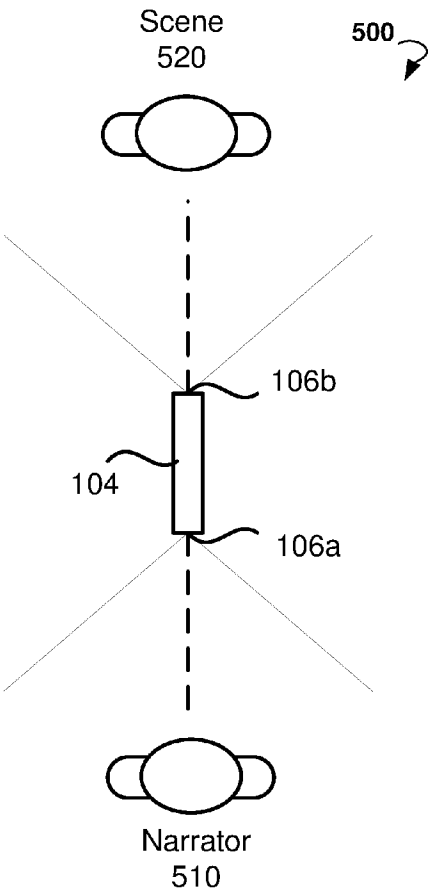
FIG. 5A is a block diagram showing example environment for directional audio signal capture using two omni-directional microphones.

FIG. 5A illustrates an example environment 500 for directional audio signal capture using two omni-directional microphones. The example environment 500 can include audio device 104, primary microphone 106*a*, secondary microphone 106*b*, a user 510 (also referred to as narrator 510) and a second sound source 520 (also referred to as scene 520). Narrator 510 can be located proximate to primary microphone 106*a*. Scene 520 can be located proximate to secondary microphone 106*b*. The audio processing system 400 may provide a dual output including a first signal and a second signal. The first signal can be obtained by focusing on a direction associated with narrator 510. The second signal can be obtained by focusing on a direction associated with scene 520. SDE module 408 (an example of which is shown in FIG. 4) can provide a vector of salience estimates to localize a direction associated with target sources, for example narrator 510 and scene 520. FIG. 5B illustrates a directional audio signal captured using two omni-directional microphones. As target sources or audio device change positions, SDE module 408 (e.g., in the system in FIG. 4) can provide an updated vector of salience estimates to allow audio processing system 400 to keep focusing on the target sources.

Figure 6:
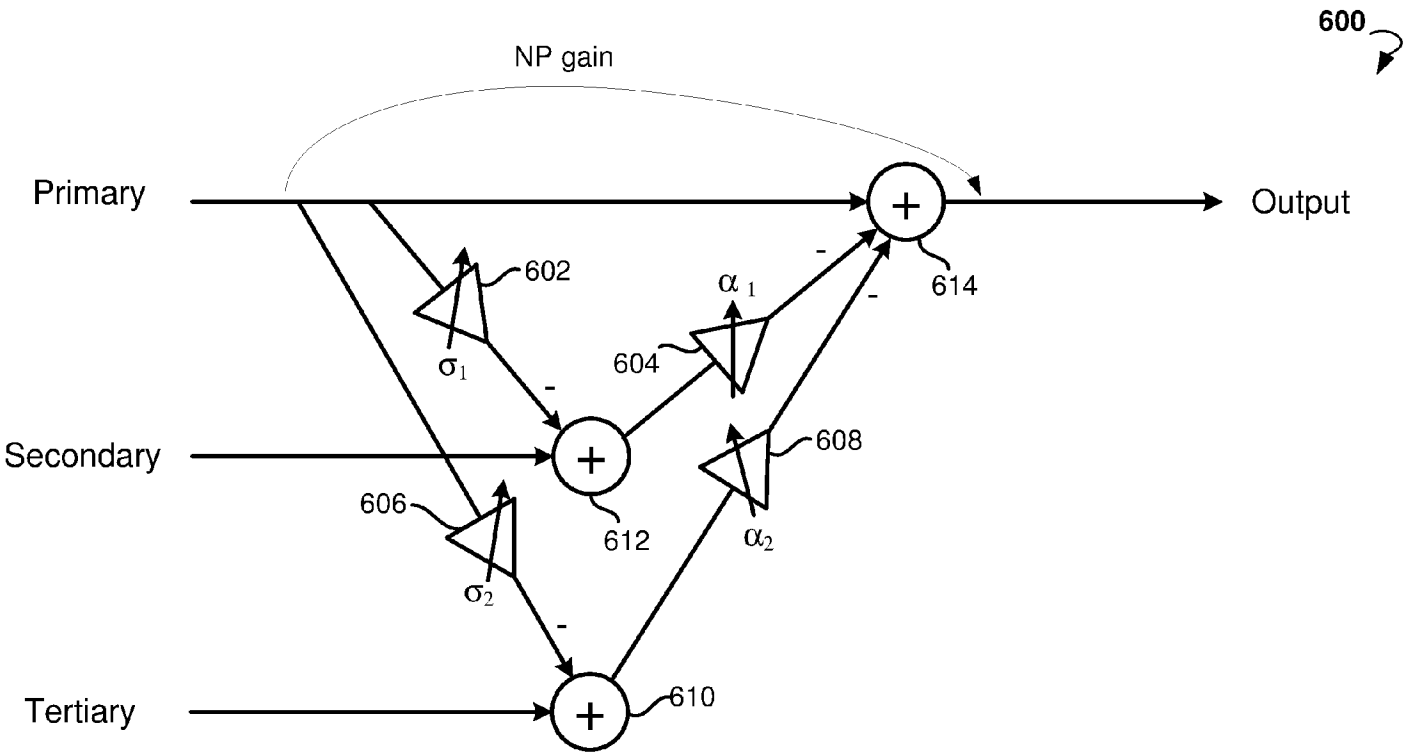
FIG. 6 is a block diagram showing a module for null processing noise subtraction.

FIG. 6 shows a block diagram of an example NPNS module 600. The NPNS module 600 can be used as a beamformer module in audio processing systems 230 or 400. NPNS module 600 can include analysis modules 602 and 606 (e.g., for applying coefficients $\sigma_1$ and $\sigma_2$ respectively), adaptation modules 604 and 608 (e.g., for adapting the beam based on coefficients $\alpha 1$ and $\alpha 2$) and summing modules 610, 612, and 614. The NPNS module 600 may provide gain factors based on inputs from a primary microphone, a secondary microphone, and, optionally, a tertiary microphone. Exemplary NPNS modules are further discussed in U.S. patent application Ser. No. 12/215,980, entitled "System and Method for Providing Noise Suppression Utilizing Null Processing Noise Subtraction" (issued as U.S. Pat. No. 9,185,487 on Nov. 10, 2015), the disclosure of which is incorporated herein by reference in its entirety.

In the example in FIG. 6, the NPNS module 600 is configured to adapt to a target source. Attenuation coefficients $\sigma_1$ and $\sigma_2$ can be adjusted based on a current direction of a target source as either the target source or the audio device moves.

Figure 7B:
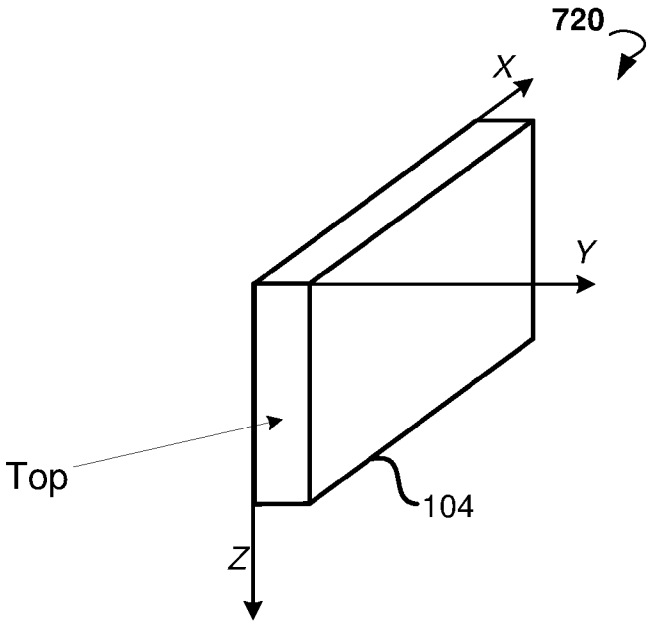
FIG. 7B is a block diagram showing coordinates used in example audio zoom audio processing.
Figure 7A:
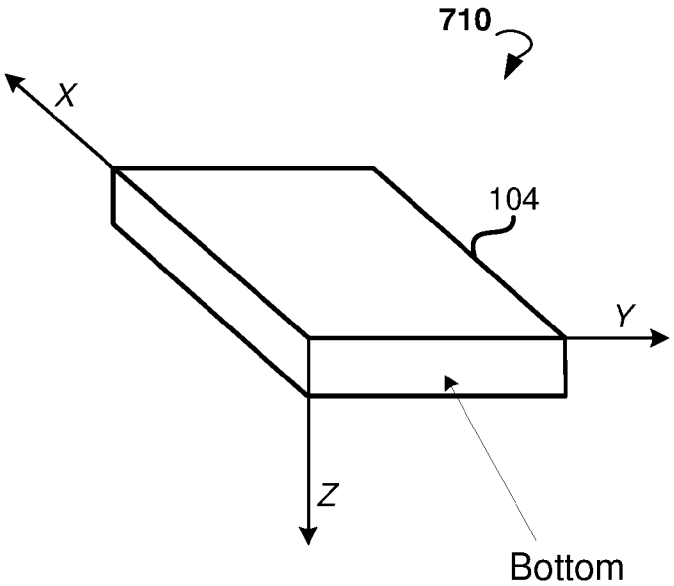
FIG. 7A is a block diagram showing coordinates used in audio zoom audio processing.

FIG. 7A shows an example coordinate system 710 used for determining the source direction in the AZA subsystem. Assuming that the largest side of the audio device 104 is parallel to the ground when, for example, the audio device 104 is placed on a table top, X axis of coordinate system 710 is directed from the bottom to the top of audio device 104.

Y axis of coordinate system 710 is directed in such a way that XY plane is parallel to the ground.

In various embodiments of the present disclosure, the coordinate system 710 used in AZA is rotated to adapt for providing a stereo separation and directional suppression of received acoustic signals. FIG. 7B shows a rotated coordinate system 720 as related to audio device 104. The audio device 104 is oriented in such way that the largest side of the audio device is orthogonal (e.g., perpendicular) to the ground and the longest edge of the audio device is parallel to the ground when, for example, the audio device 104 is held when recording a video. The X axis of coordinate system 720 is directed from the top to the bottom of audio device 104. The Y axis of coordinate system 720 is directed in such a way that XY plane is parallel to the ground.

According to various embodiments of the present disclosure, at least two channels of a stereo signal (also referred to herein as left and right channel stereo (audio) signals, and a left stereo signal and a right stereo signal) are generated based on acoustic signals captured by two or more omni-directional microphones. In some embodiments, the omni-directional microphones include the primary microphone 106*a* and the secondary microphone 106*b*. As shown in FIG. 1, the left (channel) stereo signal can be provided by creating a first target beam on the left. The right (channel) stereo signal can be provided by creating a second target beam on the right. According to various embodiments, the directions for the beams are fixed and maintained as a target source or audio device changes position. Fixing the directions for the beams allows obtaining a natural stereo effect (having left and right stereo channels) that can be heard by a user. By fixing the direction, the natural stereo effect can be heard when an object moves across the field of view, from one side to the other, for example, a car moving across a movie screen. In some embodiments, the directions for the beams are adjustable but are maintained fixed during beamforming.

Figure 8:
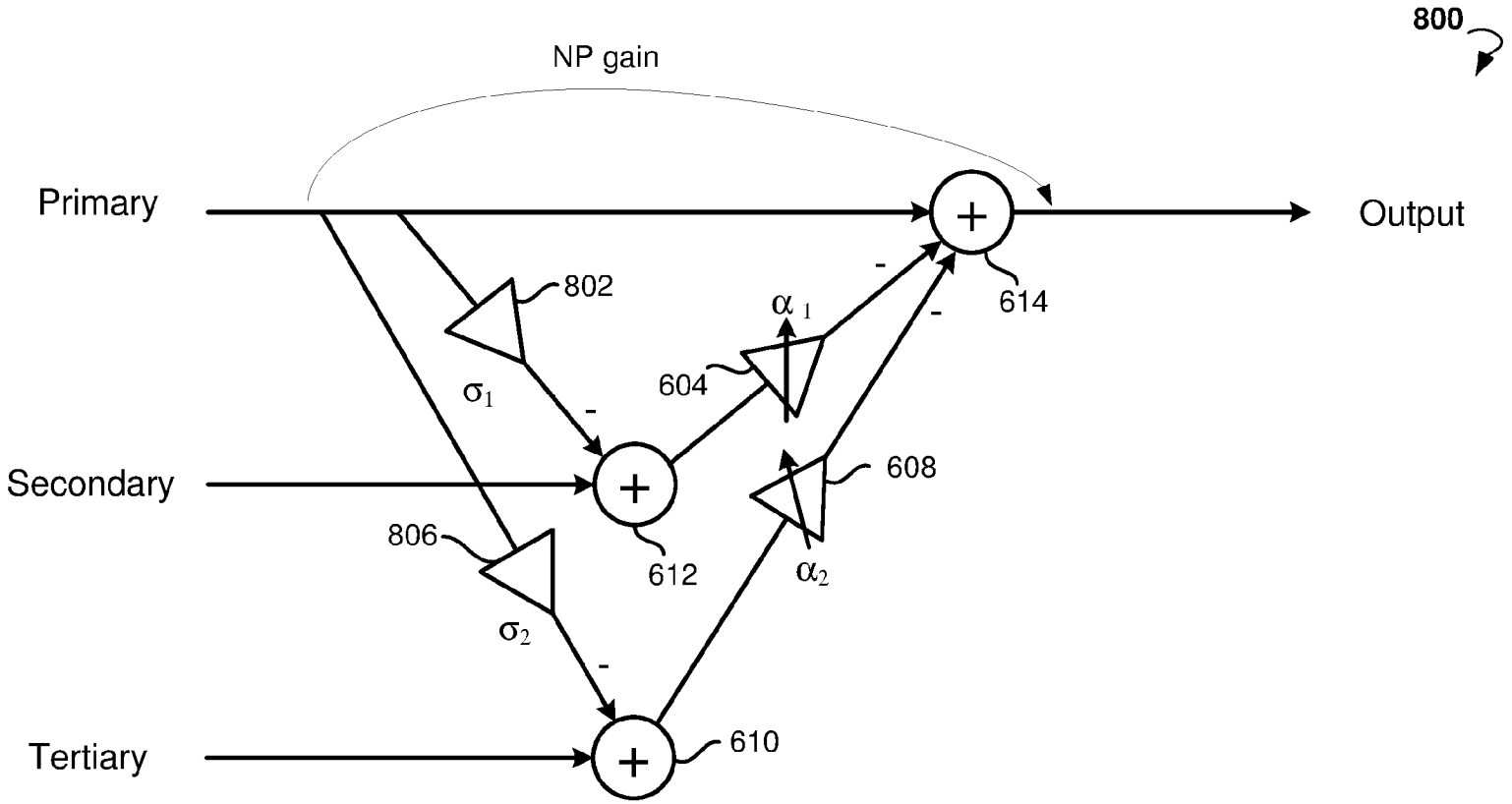
FIG. 8 is a block diagram showing an example module for null processing noise subtraction.

According to some embodiments of the present disclosure, NPNS module 600 (in the example in FIG. 6) is modified so it does not adapt to a target source. A modified NPNS module 800 is shown in FIG. 8. Components of NPNS module 800 are analogous to elements of NPNS module 600 except that the modules 602 and 606 in FIG. 6 are replaced with modules 802 and 806. Unlike in the example in FIG. 6, values for coefficients $\sigma_1$ and $\sigma_2$ in the example embodiment in FIG. 8 are fixed during forming the beams for creation of stereo signals. By preventing adaptation to the target source, the direction for beams remains fixed, ensuring that the left stereo signal and the right stereo signal do not overlap as sound source(s) or the audio device change position. In some embodiments, the attenuation coefficients $\sigma_1$ and $\sigma_2$ are determined by calibration and tuning.

Figure 9:
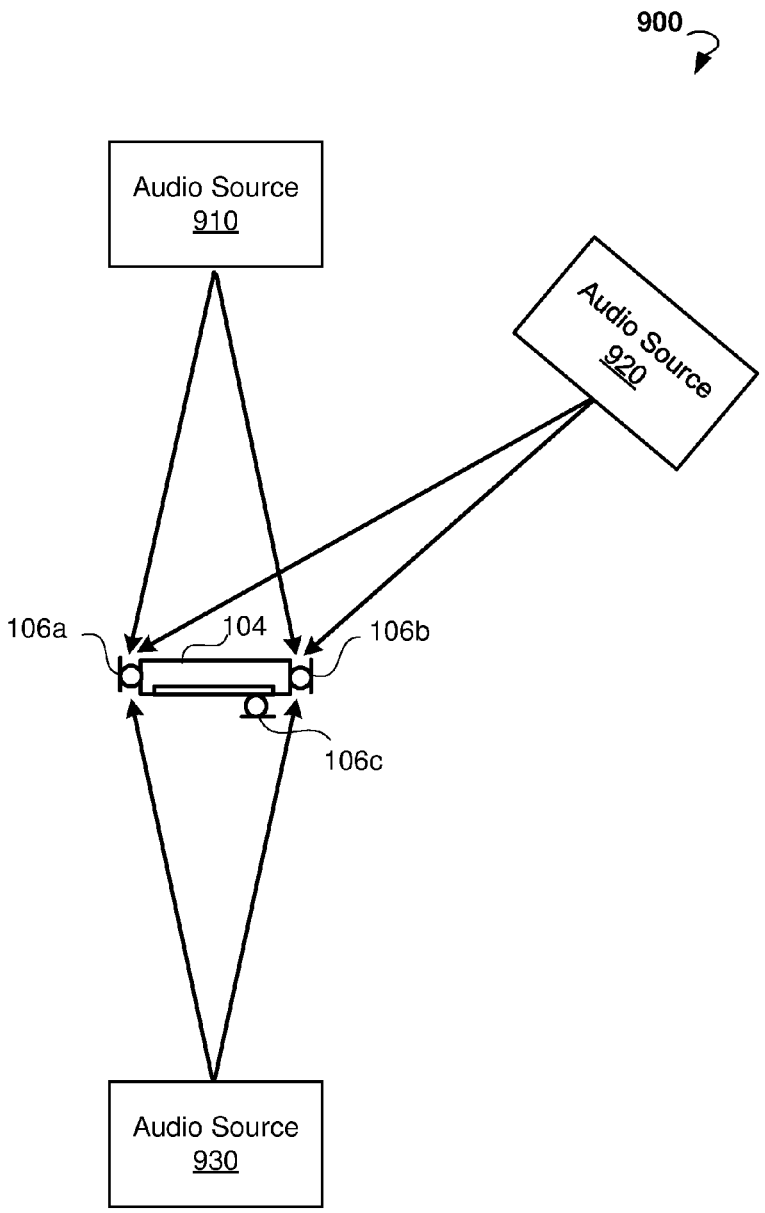
FIG. 9 is a block diagram showing a further example environment in which embodiments of the present technology can be practiced.

FIG. 9 is an example environment 900, in which example methods for stereo separation and directional suppression can be implemented. The environment 900 includes audio device 104 and audio sources 910, 920, and 930. In some embodiments, the audio device 104 includes two omni-directional microphones 106*a* and 106*b*. The primary microphone 106*a* is located at the bottom of the audio device 104 and the secondary microphone 106*b* is located at the top of the audio device 104, in this example. When the audio device 104 is oriented to record video, for example, in the direction of audio source 910, the audio processing system of the audio device may be configured to operate in a stereo recording mode. A left channel stereo signal and a right channel stereo signal may be generated based on inputs from two or more omni-directional microphones by creating a first target beam for audio on the left and a second target beam for audio on the right. The directions for the beams are fixed, according to various embodiments.

In certain embodiments, only two omni-directional microphones 106*a* and 106*b* are used for stereo separation. Using two omni-directional microphones 106*a* and 106*b*, one on each end of the audio device, a clear separation between the left side and the right side can be achieved. For example, the secondary microphone 106*b* is closer to the audio source 920 (at the right in the example in FIG. 9) and receives the wave from the audio source 920 shortly before the primary microphone 106*a*. The audio source can be then triangulated based on the spacing between the microphones 106*a* and 106*b* and the difference in arrival times at the microphones 106*a* and 106*b*. However, this exemplary two-microphone system may not distinguish between acoustic signals coming from a scene side (where the user is directing the camera of audio device) and acoustic signals coming from the user side (e.g., opposite the scene side). In the example embodiment shown in FIG. 9, the audio sources 910 and 930 are equidistant from microphones 106*a* and 106*b*. From the top view of an audio device 104, the audio source 910 is located in front of the audio device 104 at scene side and the audio source 930 is located behind the audio device at the user side. The microphones 106*a* and 106*b* receive the same acoustic signal from the audio source 910 and the same acoustic signal from audio source 930 since there is no delay in the time of arrival between the microphones, in this example. This means that, when using only the two microphones 106*a* and 106*b*, locations of audio sources 910 and 930 cannot be distinguished, in this example. Thus, for this example, it cannot be determined which of the audio sources 910 and 930 is located in front and which of the audio sources 910 and 930 is located behind the audio device.

In some embodiments, an appropriately-placed third microphone can be used to improve differentiation of the scene (audio device camera's view) direction from the direction behind the audio device. Using a third microphone (for example, the tertiary microphone 106*c* shown in FIG. 9) may help providing a more robust stereo sound. Input from the third microphone can also allow for better attenuation of unwanted content such as speech of the user holding the audio device and people behind the user. In various embodiments, the three microphones 106*a*, 106*b*, and 106*c* are not all located in a straight line, so that various embodiments can provide a full 360 degree picture of sounds relative to a plane on which the three microphones are located.

In some embodiments, the microphones 106*a*, 106*b*, and 106*c* include high AOP microphones. The AOP microphones can provide robust inputs for beamforming in loud environments, for example, concerts. Sound levels at some concerts are capable of exceeding 120 dB with peak levels exceeding 120 dB considerably. Traditional omni-directional microphones may saturate at these sound levels making it impossible to recover any signal captured by the microphone. High AOP microphones are designed for a higher overload point as compared to traditional microphones and, therefore, are capable of capturing an accurate signal under significantly louder environments when compared to traditional microphones. Combining the technology of high AOP microphones with the methods for stereo separation and directional suppression using omni-directional microphones (e.g., using high AOP omni-directional microphones for the combination) according to various embodiments of the present disclosure, can enable users to capture a video providing a much more realistic representation of their experience during, for example, a concert.

Figure 10:
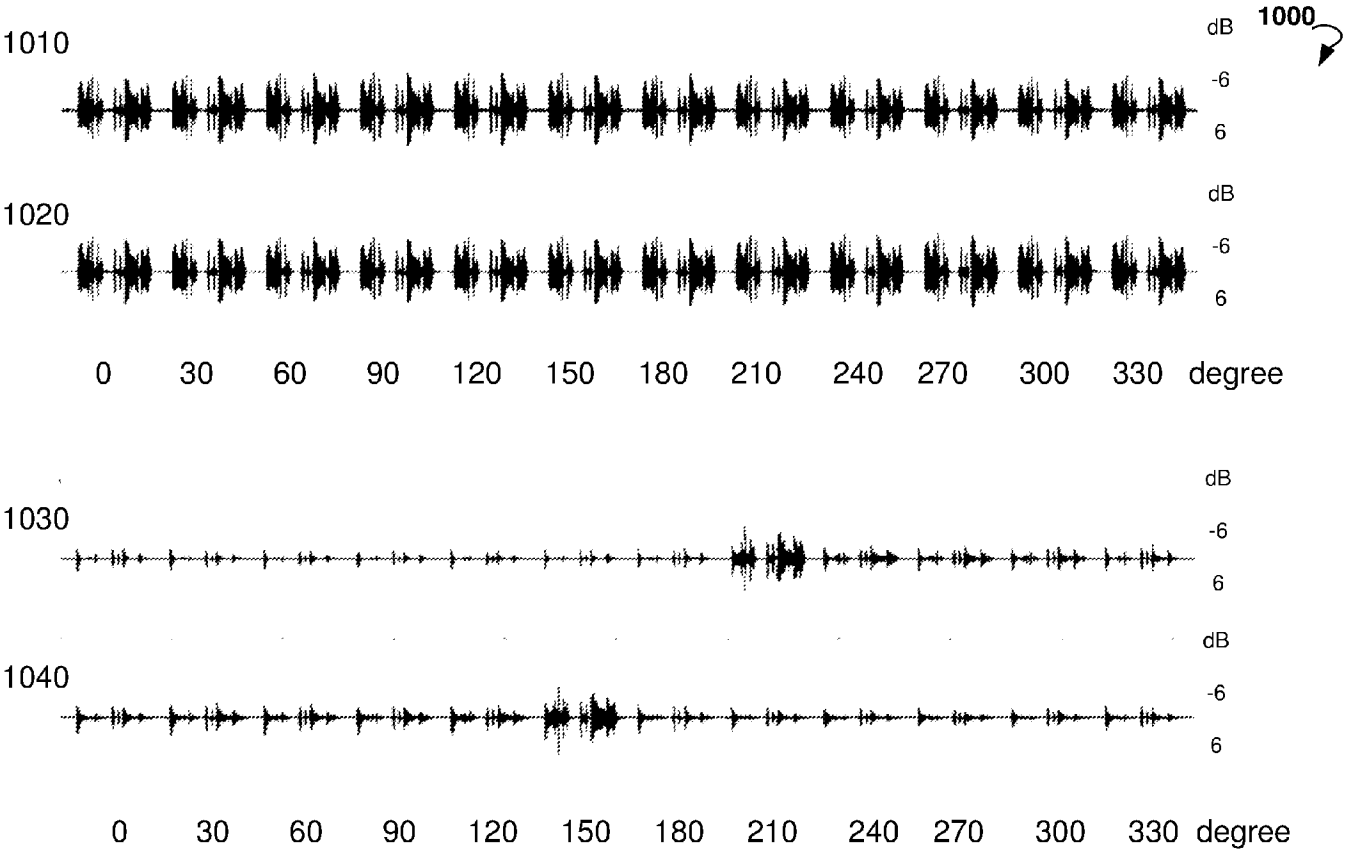
FIG. 10 depicts plots of unprocessed and processed example audio signals.

FIG. 10 shows a depiction 1000 of example plots of example directional audio signals. Plot 1010 represents an unprocessed directional audio signal captured by a secondary microphone 106*b*. Plot 1020 represents an unprocessed directional audio signal captured by a primary microphone 106*a*. Plot 1030 represents a right channel stereo audio signal obtained by forming a target beam on the right. Plot 1040 represents a left channel stereo audio signal obtained by forming a target beam on the left. Plots 1030 and 1040, in this example, show a clear stereo separation of the unprocessed audio signal depicted in plots 1010 and 1020.

Figure 11:
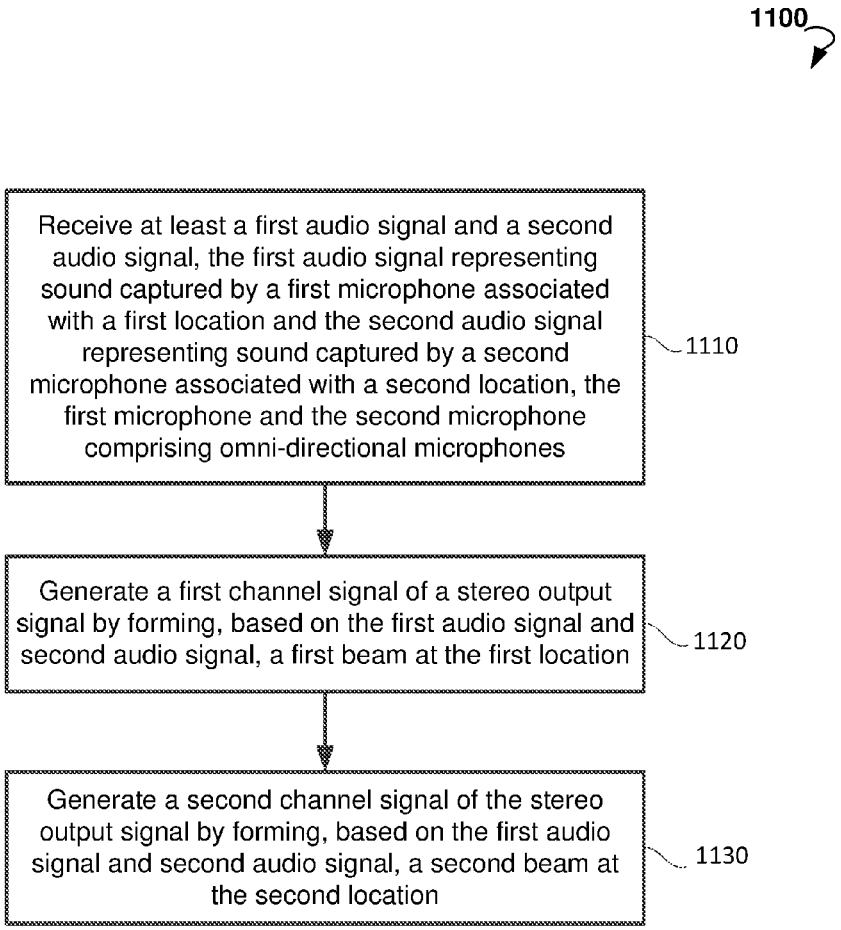
FIG. 11 is a flow chart of an example method for stereo separation and directional suppression of audio using omni-directional microphones.

FIG. 11 is a flow chart showing steps of a method for stereo separation and directional suppression, according to an example embodiment. Method 1100 can commence, in block 1110, with receiving at least a first audio signal and a second audio signal. The first audio signal can represent sound captured by a first microphone associated with a first location. The second audio signal can represent sound captured by a second microphone associated with a second location. The first microphone and the second microphone may comprise omni-directional microphones. In some embodiments, the first microphone and the second microphone comprise microphones with high AOP. In some embodiments, the distance between the first and the second microphones is limited by size of a mobile device.

In block 1120, a first stereo signal (e.g., a first channel signal of a stereo audio signal) can be generated by forming a first beam at the first location, based on the first audio signal and the second audio signal. In block 1130, a second stereo signal (e.g., a second channel signal of the stereo audio signal) can be generated by forming a second beam at the second location based on the first audio signal and the second audio signal.

Figure 12:
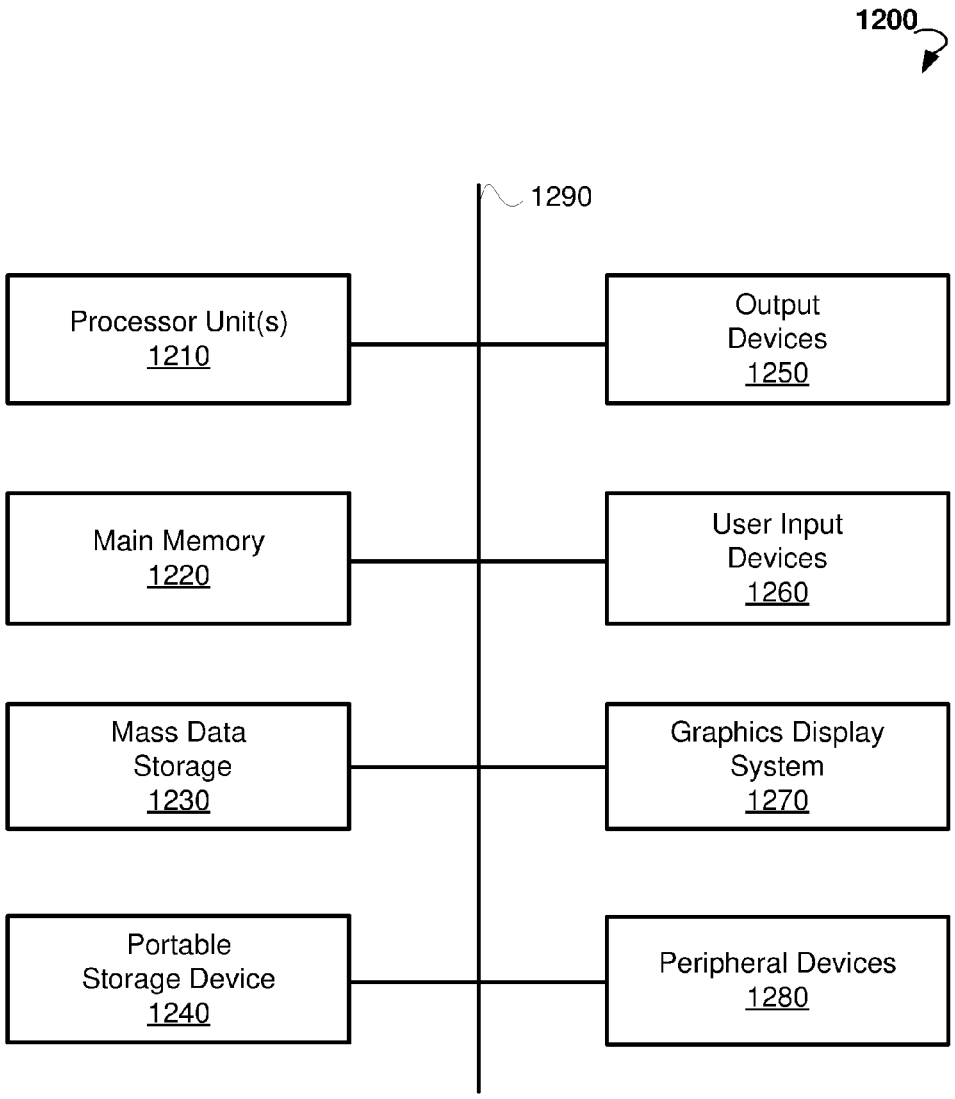
FIG. 12 is a computer system which can be used to implement example embodiment of the present technology.

FIG. 12 illustrates an example computer system 1200 that may be used to implement some embodiments of the present invention. The computer system 1200 of FIG. 12 may be implemented in the contexts of the likes of computing systems, networks, servers, or combinations thereof. The computer system 1200 of FIG. 12 includes one or more processor unit(s) 1210 and main memory 1220. Main memory 1220 stores, in part, instructions and data for execution by processor unit(s) 1210. Main memory 1220 stores the executable code when in operation, in this example. The computer system 1200 of FIG. 12 further includes a mass data storage 1230, portable storage device 1240, output devices 1250, user input devices 1260, a graphics display system 1270, and peripheral devices 1280.

The components shown in FIG. 12 are depicted as being connected via a single bus 1290. The components may be connected through one or more data transport means. Processor unit(s) 1210 and main memory 1220 is connected via a local microprocessor bus, and the mass data storage 1230, peripheral devices 1280, portable storage device 1240, and graphics display system 1270 are connected via one or more input/output (I/O) buses.

Mass data storage 1230, which can be implemented with a magnetic disk drive, solid state drive, or an optical disk drive, is a non-volatile storage device for storing data and instructions for use by processor unit(s) 1210. Mass data storage 1230 stores the system software for implementing embodiments of the present disclosure for purposes of loading that software into main memory 1220.

Portable storage device 1240 operates in conjunction with a portable non-volatile storage medium, such as a flash drive, floppy disk, compact disk, digital video disc, or Universal Serial Bus (USB) storage device, to input and output data and code to and from the computer system 1200 of FIG. 12. The system software for implementing embodiments of the present disclosure is stored on such a portable medium and input to the computer system 1200 via the portable storage device 1240.

User input devices 1260 can provide a portion of a user interface. User input devices 1260 may include one or more microphones, an alphanumeric keypad, such as a keyboard, for inputting alphanumeric and other information, or a pointing device, such as a mouse, a trackball, stylus, or cursor direction keys. User input devices 1260 can also include a touchscreen. Additionally, the computer system 1200 as shown in FIG. 12 includes output devices 1250. Suitable output devices 1250 include speakers, printers, network interfaces, and monitors.

Graphics display system 1270 include a liquid crystal display (LCD) or other suitable display device. Graphics display system 1270 is configurable to receive textual and graphical information and processes the information for output to the display device.

Peripheral devices 1280 may include any type of computer support device to add additional functionality to the computer system.

The components provided in the computer system 1200 of FIG. 12 are those typically found in computer systems that may be suitable for use with embodiments of the present disclosure and are intended to represent a broad category of such computer components that are well known in the art. Thus, the computer system 1200 of FIG. 12 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, TIZEN, and other suitable operating systems.

The processing for various embodiments may be implemented in software that is cloud-based. In some embodiments, the computer system 1200 is implemented as a cloud-based computing environment, such as a virtual machine operating within a computing cloud. In other embodiments, the computer system 1200 may itself include a cloud-based computing environment, where the functionalities of the computer system 1200 are executed in a distributed fashion. Thus, the computer system 1200, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud may be formed, for example, by a network of web servers that comprise a plurality of computing devices, such as the computer system 1200, with each server (or at least a plurality thereof) providing processor and/or storage resources. These servers may manage workloads provided by multiple users (e.g., cloud resource customers or other users). Typically, each user places workload demands upon the cloud that vary in real-time, sometimes dramatically. The nature and extent of these variations typically depends on the type of business associated with the user.

The present technology is described above with reference to example embodiments. Therefore, other variations upon the example embodiments are intended to be covered by the present disclosure.

What is claimed is:

1. A method for providing stereo separation and directional suppression, the method comprising:

configuring a processor to receive at least a first audio signal and a second audio signal, the first audio signal representing sound captured by a first microphone associated with a first location and the second audio signal representing sound captured by a second microphone associated with a second location, the first microphone and the second microphone comprising omni-directional microphones of a mobile device, the distance between the first microphone and the second microphone being limited by the size of the mobile device;

configuring the processor to generate a first channel signal of a stereo audio signal by forming, based on the first audio signal and the second audio signal, a first beam at the first location; and configuring the processor to generate a second channel signal of the stereo audio signal by forming, based on the first audio signal and the second audio signal, a second beam at the second location, wherein forming one or both of the first beam and the second beam includes:

attenuating the first audio signal by a first attenuation factor;

subtracting the attenuated first audio signal from the second audio signal to produce a first summed signal;

attenuating the first summed signal by a second attenuation factor; and subtracting the attenuated first summed signal from the first audio signal to produce a second summed signal.

2. The method of claim 1, wherein the first microphone is located at the top of the mobile device and the second microphone is located at the bottom of the mobile device.

3. The method of claim 1, wherein a first direction, associated with the first beam, and a second direction, associated with the second beam, are determined during processing to form the first and second beams.

4. The method of claim 1, wherein:

forming the first beam includes reducing signal energy of acoustic signal components associated with sources off the first beam; and forming the second beam includes reducing signal energy of acoustic signal components associated with further sources off the second beam.

5. The method of claim 4, wherein reducing energy components is performed by a subtractive suppression.

6. The method of claim 4, further comprising configuring the processor to receive at least one other acoustic signal representing sound captured by another microphone associated with another location, the other microphone comprising an omni-directional microphone, and the forming the first beam and the forming the second beam each being further based on the at least one other acoustic signal.

7. The method of claim 6, wherein the other microphone is located at a position on the mobile device other than on a line between the first microphone and the second microphone.

8. The method of claim 1, wherein a first audio source at the first location is associated with the first microphone by the first audio source being located closer to the first microphone.

9. The method of claim 8, wherein a second audio source at the second location is associated with the second microphone by the second audio source being located closer to the second microphone.

10. The method of claim 1, wherein the first microphone and the second microphone include microphones having an acoustic overload point (AOP) higher than a predetermined sound pressure level.

11. The method of claim 10, wherein the pre-determined sound pressure level is 120 decibels.

12. The method of claim 1, wherein the first and second attenuation factors are determined based on a direction of an audio source of one or both of the first audio signal and the second audio signal.

13. A system for stereo separation and directional suppression, the system comprising:

at least one processor; and a memory communicatively coupled with the at least one processor, the memory storing instructions, which when executed by the at least one processor, perform a method comprising:

receiving at least a first audio signal and a second audio signal, the first audio signal representing sound captured by a first microphone associated with a first location and the second audio signal representing sound captured by a second microphone associated with a second location, the first microphone and the second microphone comprising omnidirectional microphones of a mobile device, the distance between the first microphone and the second microphone being limited by the size of the mobile device;

generating a first channel signal of a stereo audio signal by forming, based on the first audio signal and the second audio signal, a first beam at the first location; and generating a second channel signal of the stereo audio signal by forming, based on the first audio signal and the second audio signal, a second beam at the second location, wherein forming one or both of the first beam and the second beam includes:

attenuating the first audio signal by a first attenuation factor;

subtracting the attenuated first audio signal from the second audio signal to produce a first summed signal;

attenuating the first summed signal by a second attenuation factor; and subtracting the attenuated first summed signal from the first audio signal to produce a second summed signal.

14. The system of claim 13, wherein the first microphone is located at the top of the mobile device and the second microphone is located at the bottom of the mobile device.

15. The system of claim 13, wherein a first direction associated with the first beam and a second direction associated with the second beam are determined during processing to form the first and second beams.

16. The system of claim 13, wherein:

forming the first beam includes reducing signal energy of acoustic signal components associated with sources off the first beam; and forming the second beam includes reducing signal energy of acoustic signal components associated with further sources off the second beam.

17. The system of claim 16, wherein reducing energy components is performed by a subtractive suppression.

18. The system of claim 16, wherein the method further comprises receiving at least one other acoustic signal representing sound captured by another microphone associated with another location, the other microphone comprising an omni-directional microphone, and the forming the first beam and the forming the second beam each being further based on the other acoustic signal.

19. The system of claim 18, wherein the other microphone is located at a position on the mobile device other than on a line between the first microphone and the second microphone.

20. The system of claim 13, wherein the first audio source at the first location is associated with the first microphone by the first audio source being located closer to the first microphone, and the second audio source at the second location is associated with the second microphone by the second audio source being located closer to the second microphone.

21. The system of claim 13, wherein the first microphone and the second microphone include microphones having an acoustic overload point (AOP) greater than a predetermined sound pressure level.

22. The system of claim 21, wherein the pre-determined sound pressure level is 120 decibels.

23. The system of claim 13, wherein the first and second attenuation factors are determined based on a direction of an audio source of one or both of the first audio signal and the second audio signal.

24. A non-transitory computer-readable storage medium having embodied thereon instructions, which when executed by at least one processor, perform steps of a method for stereo separation and directional suppression, the method comprising:

receiving at least a first audio signal and a-second audio signal, the first audio signal representing sound captured by a first microphone associated with a first location and the second audio signal representing sound captured by a second microphone associated with a second location, the first microphone and the second microphone comprising omnidirectional microphones of a mobile device, the distance between the first microphone and the second microphone being limited by the size of the mobile device;

generating a first channel signal of a stereo audio signal by forming, based on the first audio signal and the second audio signal, a first beam at the first location; and generating a second channel signal of the stereo audio signal by forming, based on the first audio signal and the second audio signal, a second beam at the second location, wherein forming one or both of the first beam and the second beam includes:

attenuating the first audio signal by a first attenuation factor;

subtracting the attenuated first audio signal from the second audio signal to produce a first summed signal;

attenuating the first summed signal by a second attenuation factor; and subtracting the attenuated first summed signal from the first audio signal to produce a second summed signal.

* * * * *